US011523685B2

(12) United States Patent
Kilgallon et al.

(10) Patent No.: US 11,523,685 B2
(45) Date of Patent: Dec. 13, 2022

(54) HIGH PRODUCTIVITY CONFIGURABLE WORKSTATION WITH MULTI-TIERED WORK PLATFORM

(71) Applicant: INTERMETRO INDUSTRIES CORPORATION, Wilkes-Barre, PA (US)

(72) Inventors: James Leo Kilgallon, Forty-Fort, PA (US); Carey Alan Roberts, Trucksville, PA (US); John G. Nackley, Harveys Lake, PA (US); Robert R. Steele, Sweet Valley, PA (US)

(73) Assignee: InterMetro Industries Corporation, Wilkes-Barre, PA (US)

( * ) Notice: Subject to any disclaimer, the term of this patent is extended or adjusted under 35 U.S.C. 154(b) by 370 days.

(21) Appl. No.: 16/965,933

(22) PCT Filed: Jan. 30, 2019

(86) PCT No.: PCT/US2019/015800
§ 371 (c)(1),
(2) Date: Jul. 29, 2020

(87) PCT Pub. No.: WO2019/152487
PCT Pub. Date: Aug. 8, 2019

(65) Prior Publication Data

US 2020/0383471 A1 Dec. 10, 2020

Related U.S. Application Data

(60) Provisional application No. 62/646,024, filed on Mar. 21, 2018, provisional application No. 62/623,670, filed on Jan. 30, 2018.

(51) Int. Cl.

| | |
|---|---|
| ***A47B 33/00*** | (2006.01) |
| ***A47B 13/00*** | (2006.01) |
| ***A47B 13/08*** | (2006.01) |

(52) U.S. Cl.
CPC ..... *A47B 33/00* (2013.01); *A47B 13/003* (2013.01); *A47B 13/088* (2013.01); *A47B 2200/0084* (2013.01)

(58) Field of Classification Search
CPC ..... A47B 33/00; A47B 13/003; A47B 13/088; A47B 77/022; A47B 77/00; A47B 77/16;
(Continued)

(56) References Cited

U.S. PATENT DOCUMENTS 62,082 A * 2/1867 Smith ..... A47L 19/02 4/656
1,866,455 A 7/1932 Echright
(Continued)

FOREIGN PATENT DOCUMENTS

FR 3048865 A1 9/2017
JP 2004049844 A 2/2004

OTHER PUBLICATIONS

International Search Report and Written Opinion of the International Searching Authority issued in PCT/US2019/015800, dated Jun. 10, 2019; ISA/US.
(Continued)

*Primary Examiner* — Nkeisha Smith
(74) *Attorney, Agent, or Firm* — Harness, Dickey & Pierce, P.L.C.

(57) ABSTRACT

A workstation includes a work surface disposed in a first horizontal plane and a multi-tiered food preparation receptacle positioned adjacent the work surface. The multi-tiered food preparation receptacle includes a first pair of rails and a second pair of rails. The first pair of rails defines a second horizontal plane and the second pair of rails defines a third horizontal plane. The third horizontal plane is located below the second horizontal plane and the second horizontal plane is located below the first horizontal plane. The first pair of
(Continued)

rails and the second pair of rails are configured to receive items of food service equipment and permit the items of food service equipment to translate in the multi-tiered food preparation receptacle relative to one another without interference.

28 Claims, 34 Drawing Sheets

(58) Field of Classification Search
CPC ..... A47B 77/18; A47B 2200/0084; F24C 15/108; A47F 10/06; A47J 43/00; A47J 43/06; A47J 47/00; A47J 47/005; A47J 47/16; A47J 47/20
USPC ..... 108/26; 248/27.1, 201, 200.1; 4/633, 4/643
See application file for complete search history.

(56) References Cited

U.S. PATENT DOCUMENTS 3,126,552 A * 3/1964 Scharmer ..... E03C 1/182 4/660
4,456,021 A * 6/1984 Leavens ..... E03C 1/182 134/115 R
4,766,621 A 8/1988 Rasor
6,182,305 B1 * 2/2001 O'Connell ..... F24C 15/30 4/631
7,854,030 B2 * 12/2010 Lee ..... A47K 1/00 211/41.9
8,070,110 B2 * 12/2011 Jones ..... E03C 1/33 248/200.1
9,574,333 B2 * 2/2017 O'Brien ..... A47J 47/005
9,783,967 B2 * 10/2017 Jain ..... E03C 1/18
9,968,184 B2 * 5/2018 Palazeti ..... A47B 3/06
10,925,394 B2 * 2/2021 Robinson ..... A47B 57/545
2005/0161571 A1 7/2005 Wood
2008/0066226 A1 * 3/2008 Elsinger ..... E03C 1/33 4/643
2010/0275369 A1 * 11/2010 Eilmus ..... A47J 47/005 4/631
2012/0204343 A1 * 8/2012 Shollmier ..... E03C 1/18 4/631
2013/0241127 A1 * 9/2013 Yang ..... A47J 47/005 269/15
2014/0203153 A1 7/2014 Lan
2016/0374516 A1 * 12/2016 Lammel ..... G01G 23/00 269/11
2017/0058497 A1 3/2017 Booth et al.
2017/0181542 A1 6/2017 Comeau
2017/0321954 A1 11/2017 Shrader et al.
2021/0196083 A1 * 7/2021 Raleigh ..... E03C 1/186

OTHER PUBLICATIONS

International Preliminary Report on Patentability (Chapter II of the Patent Cooperation Treaty) date of Completion, Mar. 13, 2020; IPEA/US.

* cited by examiner

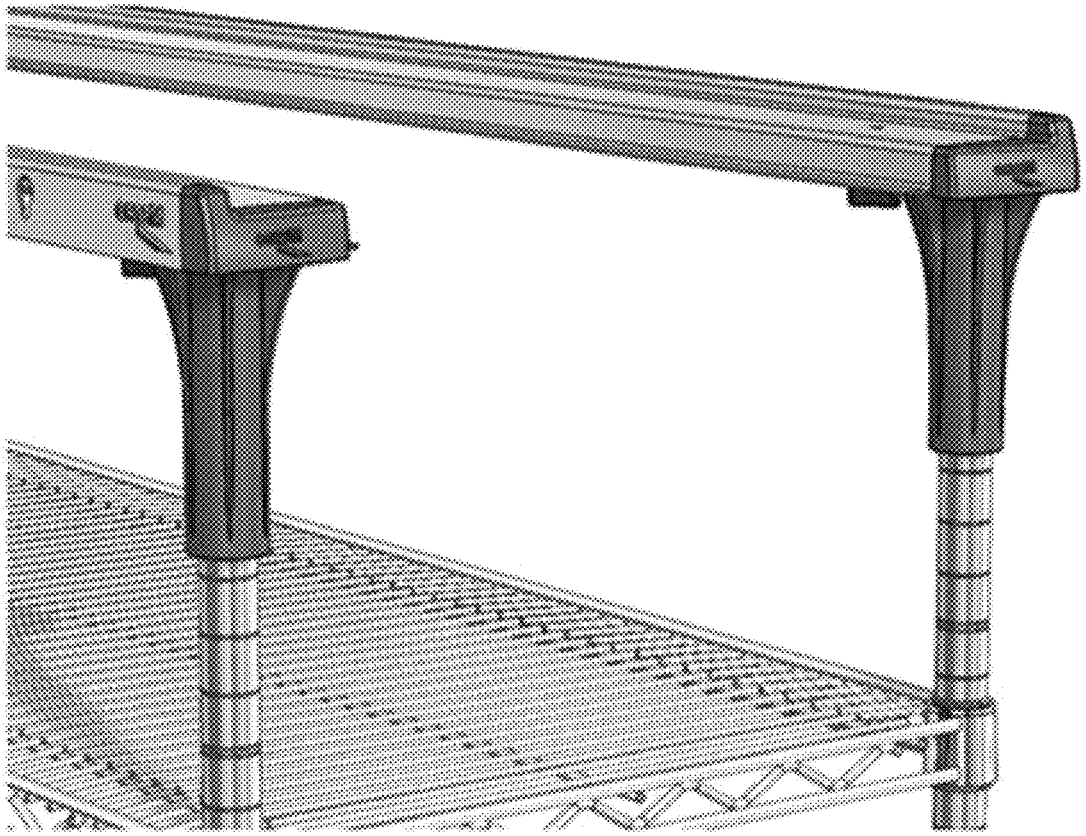
FIG. 32
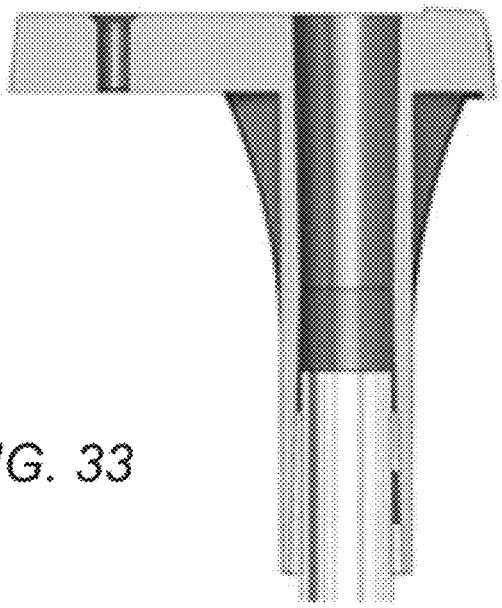
FIG. 33
FIG. 34
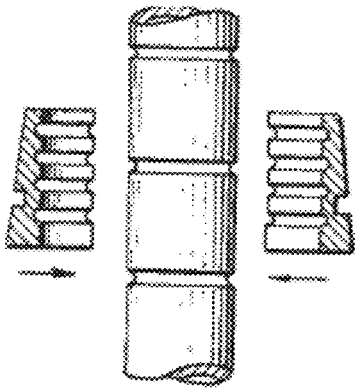

HIGH PRODUCTIVITY CONFIGURABLE WORKSTATION WITH MULTI-TIERED WORK PLATFORM

CROSS-REFERENCE TO RELATED APPLICATIONS

This application is the U.S. National Phase Application under 35 U.S.C. 371 of International Application No. PCT/US2019/015800 filed on Jan. 30, 2019, which claims the benefit of U.S. Provisional Patent Application No. 62/623,670, filed on Jan. 30, 2018 and U.S. Provisional Patent Application No. 62/646,024, filed on Mar. 21, 2018. The entire disclosures of the above applications are incorporated herein by reference.

FIELD

The present disclosure relates to configurable versatile workstations that foster high productivity and organization.

BACKGROUND

This section provides background information related to the present disclosure which is not necessarily prior art.

Workstations and work tables are found in numerous industries. The food service industry is one such industry. Food preparation can be a labor intensive endeavor that requires numerous manual tasks to be performed on a table, counter or other work surface. There exists a need, therefore, for a versatile, configurable workstation that assists in the efficient preparation of food.

SUMMARY

This section provides a general summary of the disclosure, and is not a comprehensive disclosure of its full scope or all of its features.

In one example workstation in accordance with the present disclosure, a workstation includes a work surface disposed in a first horizontal plane and a multi-tiered food preparation receptacle positioned adjacent the work surface. The multi-tiered food preparation receptacle includes a first pair of rails and a second pair of rails. The first pair of rails defines a second horizontal plane and the second pair of rails defines a third horizontal plane. The third horizontal plane is located below the second horizontal plane and the second horizontal plane is located below the first horizontal plane. The first pair of rails and the second pair of rails are configured to receive items of food service equipment and permit the items of food service equipment to translate in the multi-tiered food preparation receptacle relative to one another without interference.

In one aspect of the present disclosure, the first pair of rails is configured to removably receive a cutting board and the second pair of rails is configured to removably receive a food storage vessel such that the cutting board can move along the first pair of rails over the food storage vessel.

In another aspect of the disclosure, a food preparation workstation includes a first rail defining first boundary of the workstation and including a first support surface and a second support surface, the first support surface positioned horizontally along a length of the first rail, the second support surface positioned parallel to and vertically spaced apart from the first support surface, a second rail spaced a distance from the first rail and defining a second boundary of the workstation and including a third support surface and a fourth support surface, the third support surface positioned horizontally along a length of the second rail, the fourth support surface positioned parallel to and vertically spaced apart from the third support surface, and at least one vertically-oriented support member supporting the first rail and the second rail opposite to one another such that the first support surface and the third support surface are aligned in a first plane and define a first platform and the second support surface is and the fourth support surface are aligned in a second plane to define a second platform, the first platform being configured to removably receive a work surface and the second platform being configured to removably receive a storage receptacle, the work surface operable to translate from a first position on the first platform to a second position on the first platform.

In still another aspect of the disclosure, the work surface is operable to slide on the first platform in the first plane vertically above the storage receptacle and without interfering with the storage receptacle.

In still another aspect of the disclosure, the second support surface and the fourth support surface are positioned intermediate the first support surface and the third support surface such that the second platform is positioned inward of the first platform relative to at least one of the first and second boundaries and vertically below the first platform.

In still another aspect of the disclosure, the storage receptacle comprises a food service pan disposed between the first rail and the second rail.

In still another aspect of the disclosure, the first rail includes a first ridge that projects vertically upward from the first support surface along the length of the first rail and the second rail includes a second ridge that projects vertically upward from the third support surface along the length of the second rail, the first ridge and the second ridge operable to guide the work surface during translation of the work surface from the first position to the second position on the first platform.

In still another aspect of the disclosure, the work surface is a cutting board.

In still another aspect of the disclosure, the food preparation workstation includes a cradle connected to the at least one vertically-oriented support member, the cradle being generally U-shaped and including a first side connected to the first rail and a second side connected to the second rail.

In still another aspect of the disclosure, the first rail comprises a longitudinal section removably positioned between a first pair of endcaps and/or the second rail comprises a second longitudinal section removably positioned between a second pair of endcaps. In still another aspect of the disclosure, each endcap in the first pair of endcaps and the second pair of endcaps includes a sleeve, the at least one vertically-oriented support member is four vertical support members each removably received in the sleeve of a respective one of the endcaps.

In still another aspect of the disclosure, the food preparation workstation includes a plurality of collars, each of the plurality of collars positioned between a respective sleeve and a respective vertically-oriented support member to maintain a relative position of the respective vertically-oriented support member to the respective sleeve, and a first and second of the four vertically-oriented support members support the first rail at a first vertical height and a third and fourth of the four vertically-oriented support members support the second rail at the first vertical height.

In still another aspect of the disclosure, each sleeve has an elongated tubular shape and each collar is operable to engage the respective vertically-oriented support member in at least a first vertical location and in a second vertical location on the respective vertically-oriented support member, the first vertical location corresponding to the first vertical height of the first and second rails and the second vertical location corresponding to a second vertical height of the first and second rails.

In still another aspect of the disclosure, the food preparation workstation includes a first rail including a first support surface and a second support surface, the first support surface positioned horizontally along a length of the first rail, the second support surface positioned parallel to and vertically spaced apart from the first support surface, a second rail including a third support surface and a fourth support surface, the third support surface positioned horizontally along a length of the second rail, the fourth support surface positioned parallel to and vertically spaced apart from the third support surface, a first vertically-oriented support member positioned at or near a first longitudinal end of the first rail and a second vertically-oriented support member positioned at or near a second longitudinal end of the first rail, and a third vertically-oriented support member positioned at or near a first longitudinal end of the third rail and fourth vertically-oriented support member positioned at or near a second longitudinal end of the second rail, the first rail and the second rail are positioned substantially parallel to one another to align the first support surface with the third support surface in a first plane and to align the second support surface with the fourth support surface in a second plane.

In still another aspect of the disclosure, the first rail is spaced apart from the second rail at a predetermined distance that is configured to accommodate a work surface on the first and third support surfaces in the first plane and a storage receptacle on the second and fourth support surfaces in the second plane.

In still another aspect of the disclosure, the first plane and the second plane are horizontal planes.

In still another aspect of the disclosure, the first plane is positioned vertically above the second plane.

In still another aspect of the disclosure, the second support surface and the fourth support surface are disposed between the first support surface and the third support surface.

In still another aspect of the disclosure, the work surface comprises a cutting board.

In still another aspect of the disclosure, at least one of the first rail and the second rail includes a plurality of attachment holes to removably attach one of a hook, towel bar, storage compartment, knife holder, ingredient bin and auxiliary work platform.

In still another aspect of the disclosure, the food preparation workstation includes at least one vertically-oriented support member located below each of the first and second rails and at least one horizontally-oriented shelf connected to at least one of the vertically-oriented support members.

In still another aspect of the disclosure, the food preparation workstation includes a work surface disposed in a first horizontal plane and a mult-tiered food preparation receptacle positioned adjacent the work surface and including a first pair of rails and a second pair of rails, the first pair of rails defining a second horizontal plane and the second pair of rails defining a third horizontal plane, the third horizontal plane is located below the second horizontal plane, and the second horizontal plane is located below the first horizontal plane.

In still another aspect of the disclosure, the first pair of rails is configured to removably receive a work surface and the second pair of rails is configured to removably receive a storage receptacle such that the work surface can move from a first position to a second position along the first pair of rails above the storage receptacle.

In still another aspect of the disclosure, the work surface is operable to slide along the first pair of rails in the first horizontal plane vertically above the storage receptacle and without interfering with the storage receptacle.

In still another aspect of the disclosure, the food preparation workstation includes a cradle including a first side, a second side and a bottom, the first side connected to and spaced apart from the second side by the bottom, a first rail connected to the first side of the cradle, the first rail defining a front side of the workstation and including a first support surface and a second support surface, the first support surface positioned horizontally along at least a portion of a length of the first rail, the second support surface positioned parallel to and vertically spaced apart from the first support surface, and a second rail connected to the second side of the cradle, the second rail spaced at a distance from the first rail and defining a rear side of the workstation and including a third support surface and a fourth support surface, the third support surface positioned horizontally along at least a portion of a length of the first rail and in a first common plane with the first support surface, the fourth support surface positioned in a second common plane as the second support surface, the first support surface and the third support surface define a first platform that is configured to receive a removable planar work surface, and the second support surface and the fourth support surface define a second platform that is configured to receive a removable storage receptacle.

In still another aspect of the disclosure, the storage receptacle is operable in a first position and a second position relative to the work surface on the second platform.

In still another aspect of the disclosure, the cradle is generally U-shaped and the bottom of the cradle is vertically spaced below the second platform to allow the storage receptacle to be positioned between the first and second sides of the cradle and vertically above the bottom of the cradle.

In still another aspect of the disclosure, the food preparation workstation includes at least one vertically-oriented support member connected to the cradle and supporting the cradle at a first vertical height.

In still another aspect of the disclosure, the at least one vertically-oriented support member includes two or more telescoping sections that can move relative to one another to move the cradle from the first vertical height to a second vertical height.

In still another aspect of the disclosure, the first rail includes at least one pad on the first support surface or the second support surface, the at least one pad comprising a material with a higher coefficient of friction than a material of the first rail that is adjacent the at least one pad.

In still another aspect of the disclosure, the first rail includes a plurality of dimples or projections positioned on the first support surface, the plurality of dimples or projections configured to nest with a corresponding plurality of projections or dimples on the work surface to resist movement of the work surface relative to the first rail.

In still another aspect of the disclosure, the first rail comprises a longitudinal section removably positioned between a pair of endcaps.

In still another aspect of the disclosure, each endcap includes a top projection projecting inward in a direction substantially perpendicular to a longitudinal direction of the first or second rails, the top projection spaced vertically above the second support surface to prevent the storage receptacle from disengaging the second support surface.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 32 is a partial perspective view of another example of a workstation in accordance with the present disclosure having a height adjustment feature for a work platform;

FIG. 33 is a cross-sectional view of the height adjustment feature shown in FIG. 32; and FIG. 34 is a partial, exploded detail view of a support collar for use with the height adjustment feature shown in FIG. 32.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The workstations of the present disclosure are versatile and configurable pieces of equipment that can be used by workers to improve efficiency in the performance of a variety of tasks. As will be described, the workstations can be adapted and used so that a worker's movements are minimized during the performance of various processes. The example workstations described below are explained with respect to the food service industry. As can be appreciated, however, the workstations of the present disclosure and the principles and embodiments described herein can be adapted and applied across a variety of industries and processes, including manual assembly processes, quality control and inspection processes and the like.

Figure 1:
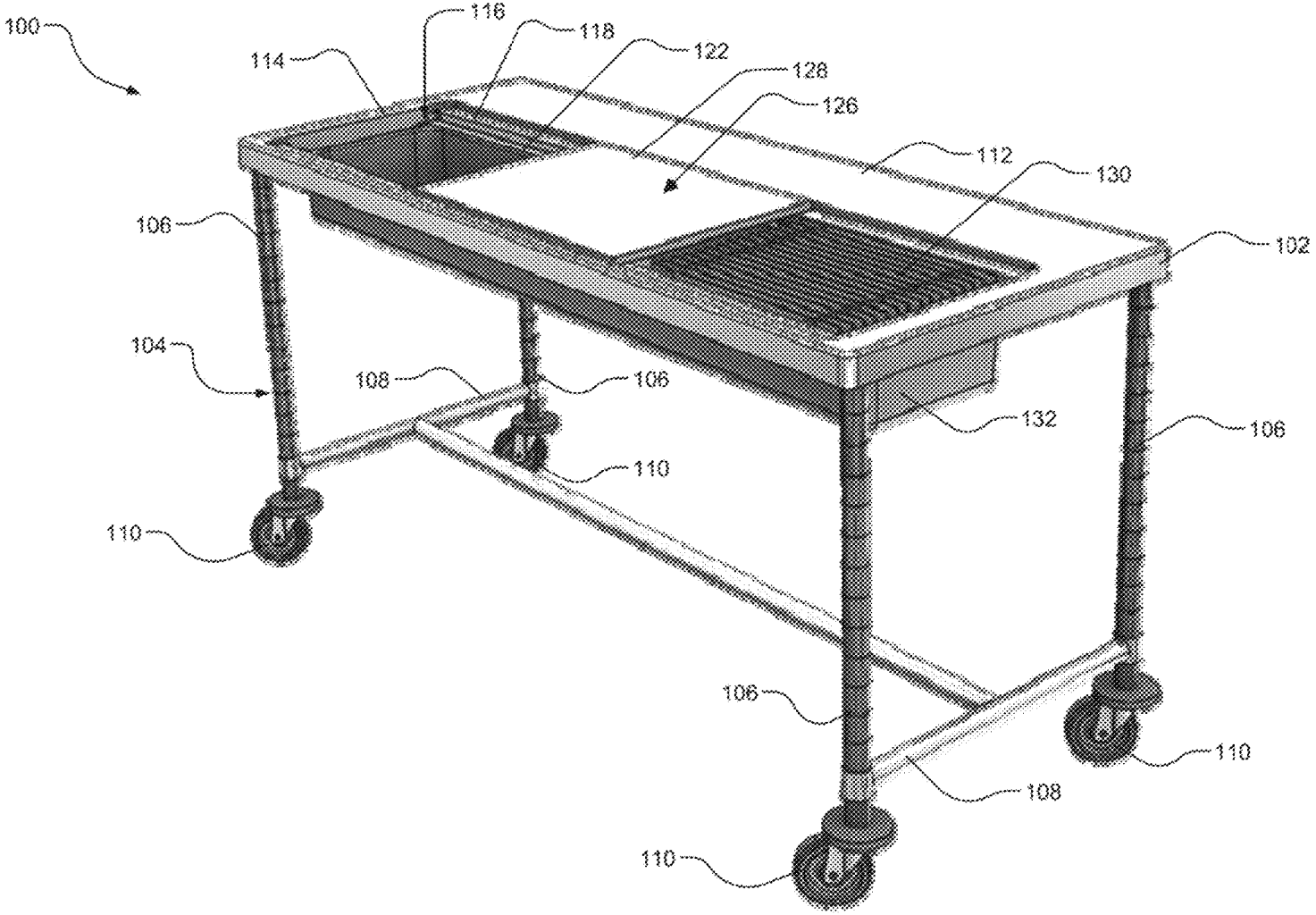
FIG. 1 is a perspective view of one example workstation in accordance with the present disclosure.

Referring now to FIG. 1, one example embodiment of a workstation 100 includes a work platform 102 and a base 104. The work platform 102 is a horizontally oriented platform on which a worker can perform a variety of tasks. The work platform 102 includes one or more removable elements, storage vessels and other food service related equipment to assist the worker in efficiently organizing, preparing and cleaning food items.

The base 104 is a structure that supports the work platform 102 at a desired horizontal height above the floor. As shown in this example, the base 104 includes one or more legs 106, one or more braces 108 and one or more casters 110. The legs 106 are vertical columns that are connected to the work platform 102 and extend downward to support the work platform 102. In this example, the workstation 100 includes four legs 106 with one leg positioned at each corner of the work platform 102.

The braces 108, in this example, are connected to and extend between the legs 106. The braces 108 maintain the rigidity of the base 104. The casters 110 are connected to the bottom of each of the legs 106. In this manner, the workstation 100 can be easily moved to a desired location by rolling the workstation 100 on the casters 110. The casters 110 can include a releasable locking mechanism whereby the wheels on the casters 110 can be locked in position to prevent undesired movement of the workstation 100 once the workstation 100 has been placed in a desired location.

In other examples of the workstation 100, the legs 106, the braces 108 and the casters 110 can have other configurations. For example, the workstation can have more or less legs 106, braces 108 and casters 110. Still further, the legs 106 and the braces 108 can have rectangular, square or other cross-sectional profiles in addition to the round cross-sectional profile as shown.

The work platform 102 includes a work surface 112 and an opening 114. The work surface 112, as shown in FIG. 1, is a horizontal surface. Food items, utensils, ingredients or other items can be placed on and manipulated on the work surface 112. The opening 114 is a rectangular opening in the work platform 102 that is positioned adjacent the work surface 112. In this example, the opening 114 extends across the length of the work platform 102. As will be further explained, the opening 114 permits the multi-tiered elements of the work platform 102 to be located at or below a horizontal plane defined by the work surface 112.

Figure 2:
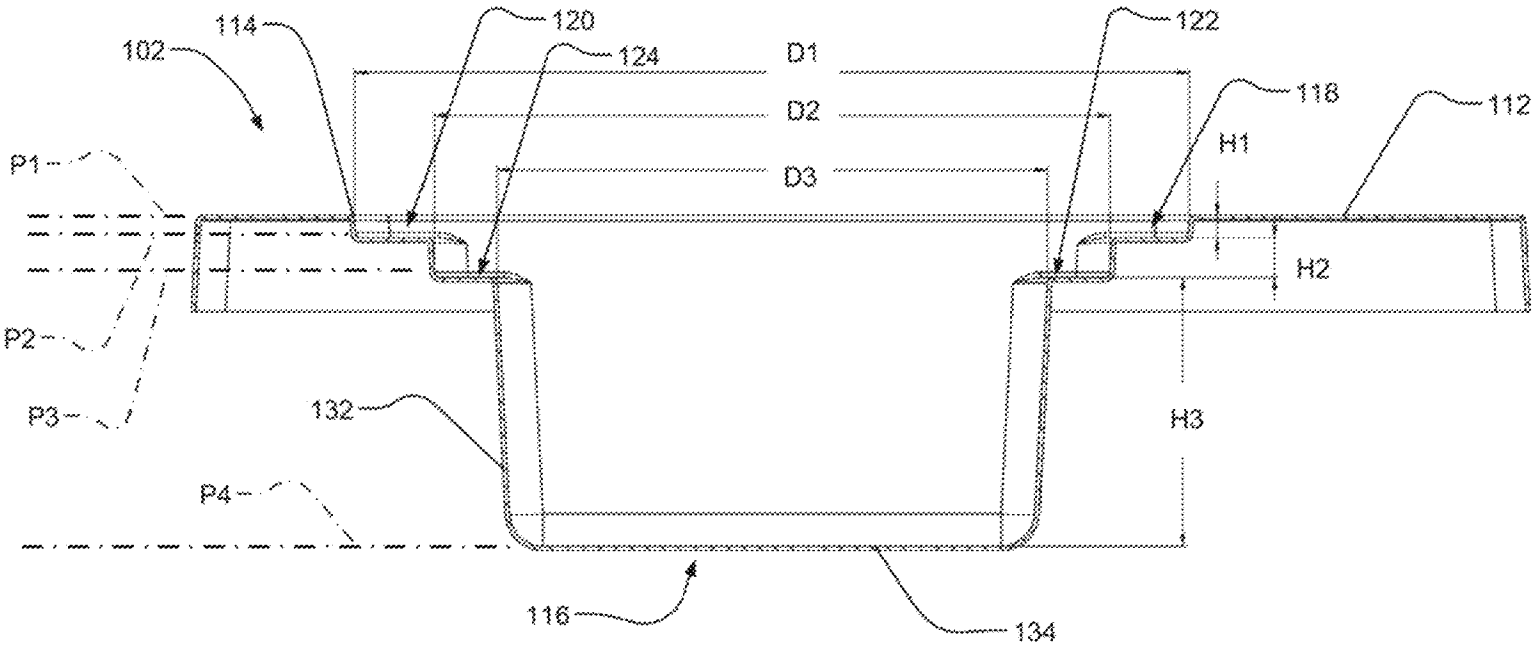
FIG. 2 is a cross-sectional view of the work platform of the example workstation shown in FIG. 1.
Figure 2A:
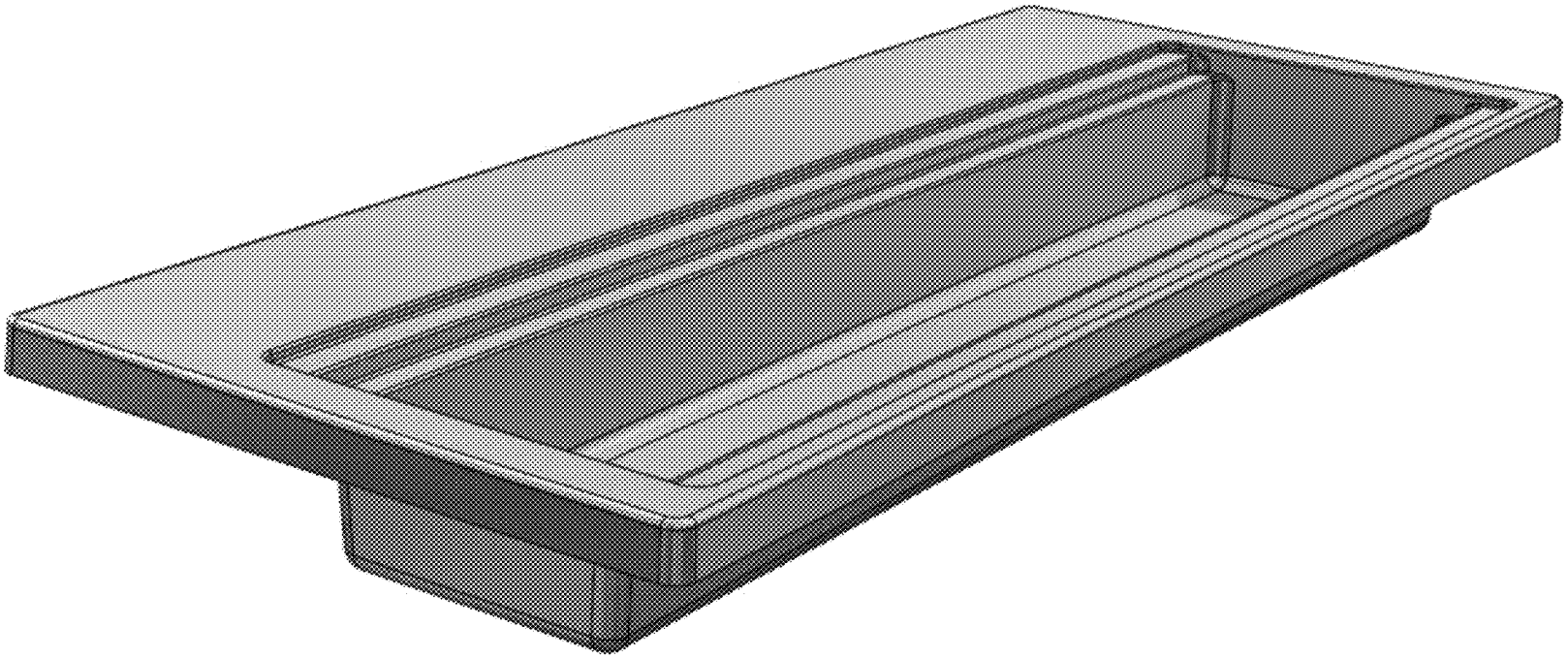
FIG. 2A is a perspective view of the work platform shown in FIG. 2.

FIG. 2 shows an example cross section of the work platform 102. As shown, the work platform 102 is multi-tiered in that it includes at least two layers of food preparation equipment that nest horizontally inside the opening 114. As shown, work platform 102 includes a multi-tiered receptacle 116. The multi-tiered receptacle 116 includes a plurality of rails denoted as 118, 120, 122 and 124. The rails 118, 120, 122 and 124 are positioned within the opening 114 and extend along the length of the opening 114. The rails 118, 120, 122 and 124 are arranged as pairs on opposite sides of the opening 114. A first pair of rails includes rail 118 and rail 120. A second pair of rails includes rail 122 and 124.

The first pair of rails 118, 120 is positioned substantially parallel to and at a vertical height H1 below the work surface 112. The rail 118 extends along the back side of the opening 114 and the rail 120 extends parallel to the first rail 118 along the front side of the opening 114. The first pair of rails 118, 120 creates a first track upon which an item of food service equipment can be rested.

As shown in FIG. 1, the first pair of rails 118, 120 is configured to receive a cutting board 126. The first pair of rails 118, 120 is spaced such that a bottom surface of the cutting board 126 rests on the first pair of rails 118, 120 in the multi-tiered receptacle 116. The vertical height H1 is greater than or equal to a thickness of the cutting board 126. In this configuration, the top surface 128 of the cutting board 126 is positioned to be co-planar with the work surface 112 or can be positioned below the work surface 112.

The second pair of rails 122, 124 is configured similarly to the first pair of rails 118, 120 except that the second pair of rails 122, 124 is positioned below and inward of the first pair of rails 118, 120. The second pair of rails 122, 124 creates a second track upon which another item of food service equipment can be rested. In the example shown in FIG. 1, a grate 130 is inserted into the multi-tiered receptacle 116 and is resting on the second pair of rails 122, 124. The vertical height H2 is greater than or equal to the thickness of the grate 130. In this manner, the grate 130 is positioned below the cutting board 126 and the grate 130 and the cutting board 126 can move independently of each other without interference.

As shown in FIG. 1, the first pair of rails 118, 120 and the second pair of rails 122, 124 extend along the length of the work platform 102 so that the cutting board 126 and the grate 130 can be translated along the rails to a desired position on the work platform 102. As previously described, the first pair of rails 118, 120 and the second pair of rails 122, 124 are layered at different vertical heights in order to permit the cutting board 126 or the grate 130 to be translated along the multi-tiered receptacle 116 as desired.

Referring back to FIG. 2, the multi-tiered receptacle 116 may also include a basin 132. The basin 132, in this example, is connected to and extends below the first pair of rails 122, 124. The basin 132 encloses the multi-tiered receptacle 116. The bottom wall 134 of the basin 132 is positioned at a vertical height H3 below the second pair of rails 122, 124.

As shown in FIG. 2, the multi-tiered receptacle 116 is configured such that it creates a plurality of horizontal working planes. The work surface 112 defines a first working plane P1. The first pair of rails 118, 120 defines a second working plane P2. The second pair of rails 122, 124 defines a third working plane P3 and the bottom wall 134 of the basin 132 defines a fourth working plane P4. The first working plane P1, the second working plane P2, the third working plane P3 and the fourth working plane P4 are oriented substantially parallel to one another at varying vertical heights relative to one another such that a food service worker can independently access food or food service equipment that is located on one of the working planes in order to efficiently process food preparation, food storage and waste disposal.

In other examples of the work platform 102, the multi-tiered receptacle 116 can include more or less working planes than the configuration previously described. In other such examples, the multi-tiered receptacle 116 may only include two working planes. In another example, the multi-tiered receptacle 116 can include five or more working planes.

Referring back to FIGS. 1 and 2, a depth of the opening 114 in the work platform 102 has a distance of D1. The first pair of rails 118, 120 project inwardly toward one another along the second plane P2 from the opening 114 such that the inward side edges of the first pair of rails 118, 120 are separated by a distance D2. The second pair of rails 122, 124 project inwardly toward one another along the third plane P3 from the inward side edges of the first pair of rails 118, 120. The inward side edges of the second pair of rails 122, 124 are separated by a distance D3.

In this configuration, the multi-tiered receptacle 116 is configured to receive one or more items of food service equipment (e.g., the cutting board 126 or the grate 130) on the first pair of rails 118, 120 and/or the second pair of rails 122, 124. As such, the distance D1 and the distance D2 are greater than the depth (or width) of the item of food service equipment that is placed on the first pair of rails 118, 120 and/or the second pair of rails 122, 124.

In the example shown, the cutting board 126 and the grate 130 are inserted into the multi-tiered receptacle 116 on the first pair of rails 118, 120 and the second pair of rails 122, 124, respectively. The multi-tiered receptacle 116 can also accept other items of food service equipment. For example, the distance D1, the distance D2 and/or the distance D3 can be appropriately sized so as to accept a U.S. or gastronorm sized food container. These food containers are sized according to known standards and the multi-tiered receptacle 116 can be sized accordingly.

For example, the first pair of rails 118, 120 can be spaced apart by a distance of D1 so as to accept a standardized baking sheet or baking pan. In another example, the second pair of rails 122, 124 can be spaced apart by a distance D3 such that the flange of a full size gastronorm pan rests on the second pair of rails 122, 124 and the base of the full size gastronorm pan extends below the working plane P3. In such an example, the baking sheet can slide along the first pair of rails 118, 120 and the full size gastronorm pan can slide along the second pair of rails 122, 124 independently of each other.

As previously described, the basin 132 of the multi-tiered receptacle 116 is enclosed. The basin 132 may include a drain or other opening (not shown) in order to permit a liquid or other material to be easily removed from the basin 132. In other examples, the basin 132 may include an opening in the bottom wall 134 so that larger items of food can be removed through the bottom wall 134 rather than requiring a worker to collect and lift the food through the opening 114. In still other examples, the multi-tiered receptacle 116 may not include the basin 132. In such examples, the second pair of rails 122, 124 is the lower-most structure on the multi-tiered receptacle 116. In such examples, a pan can be placed on the second pair of rails 122, 124 to serve a similar purpose to that of the basin 132. In still other examples, a third pair of rails (not shown) is provided. A pan or other vessel can be placed on such a third pair of rails to create a removable basin.

Figure 4:
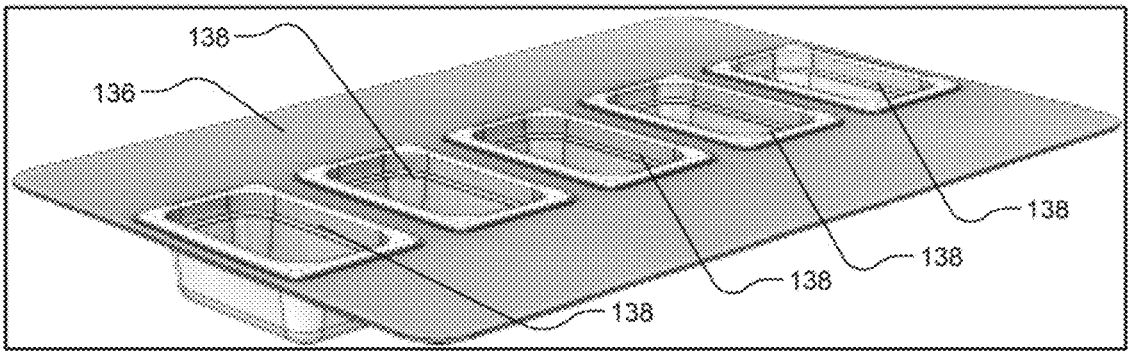
FIG. 4 is an illustration of an example panel that can be used in connection with the workstations of the present disclosure.
Figure 5:
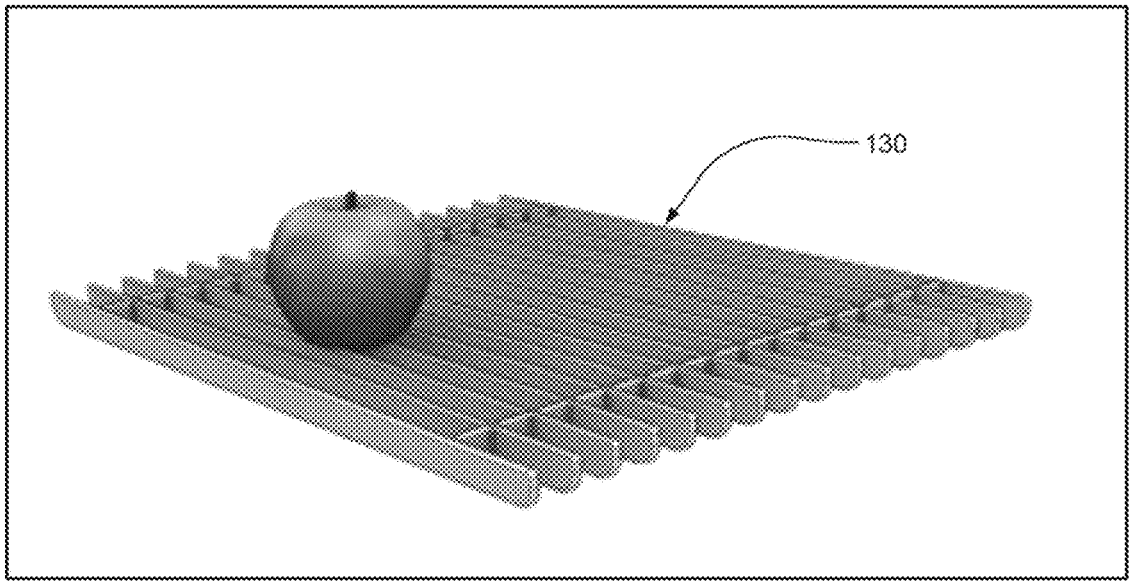
FIG. 5 is an illustration of an example grate that can be used in connection with the workstations of the present disclosure.

In still other examples, the multi-tiered receptacle 116 can be sized and configured to accept other items of food service equipment such as other food storage containers, cooking equipment, food temperature control equipment, ingredient containers, cleaning equipment, drying equipment, waste disposal equipment and the like. FIGS. 4 and 5 show examples of items of food service equipment that can be inserted into the multi-tiered receptacle 116. A panel 136 can be inserted into the multi-tiered receptacle 116. As shown, the panel 136 can include one or more openings that are configured to receive pans 138 or other food bins. In this example, the panel 136 includes five openings to receive five pans 138. In other examples, the panel 136 can include more than five openings or less than five openings and can be configured to receive other types and sizes of food bins. The panel 136 is sized so as to rest on either the first pair of rails 118, 120 or the second pair of rails 122, 124. The panel 136 is shown positioned in an example multi-tiered receptacle 116 in FIG. 8.

FIG. 5 shows an example embodiment of the grate 130. As shown, the grate can include one or more bars separated from one another. As can be appreciated, the grate 130 can be advantageously used in the multi-tiered receptacle 116 to support fruit, vegetables or other items that have been washed. The grate 130 permits water or other liquid to drain off of the food items and be collected in the basin 132 of the multi-tiered receptacle 116.

In the example shown, the multi-tiered receptacle 116 is molded from a suitable plastic material to include the structure as described. In other examples, the multi-tiered receptacle 116 can be formed from one or more pieces of plastic, stainless steel or other suitable material. A microbial inhibitor additive or surface coating can be added to the multi-tiered receptacle (or to other elements of the workstation 100) to inhibit the growth of bacteria or other contaminants.

As previously described and as shown in the example of FIG. 1, the multi-tiered receptacle 116 is rectangular in shape and extends laterally along the work platform 102. In other examples, the multi-tiered receptacle 116 can have other shapes and/or extensions. In one such example (not shown), the multi-tiered receptacle 116 has a T-shape. In the T-shaped example, the multi-tiered receptacle 116 has an extension that extends substantially perpendicularly to the rectangular profile shown in FIG. 1. The extension (not shown) includes a cross-section similar to that previously described. The extension, in this alternate configuration, includes a first pair of rails 118, 120, a second pair of rails 122, 124 and a basin 132. Such an extension would permit the items of food service equipment that are placed on the first pair of rails 118, 120 and/or the second pair of rails 122, 124 to be moved into and out of the extension (i.e., in a fore-aft direction) in addition to being able to move transversely along the opening 114. In such an alternate example, additional items of food service equipment can be placed into the multi-tiered receptacle 116 for further versatility.

Figure 3:
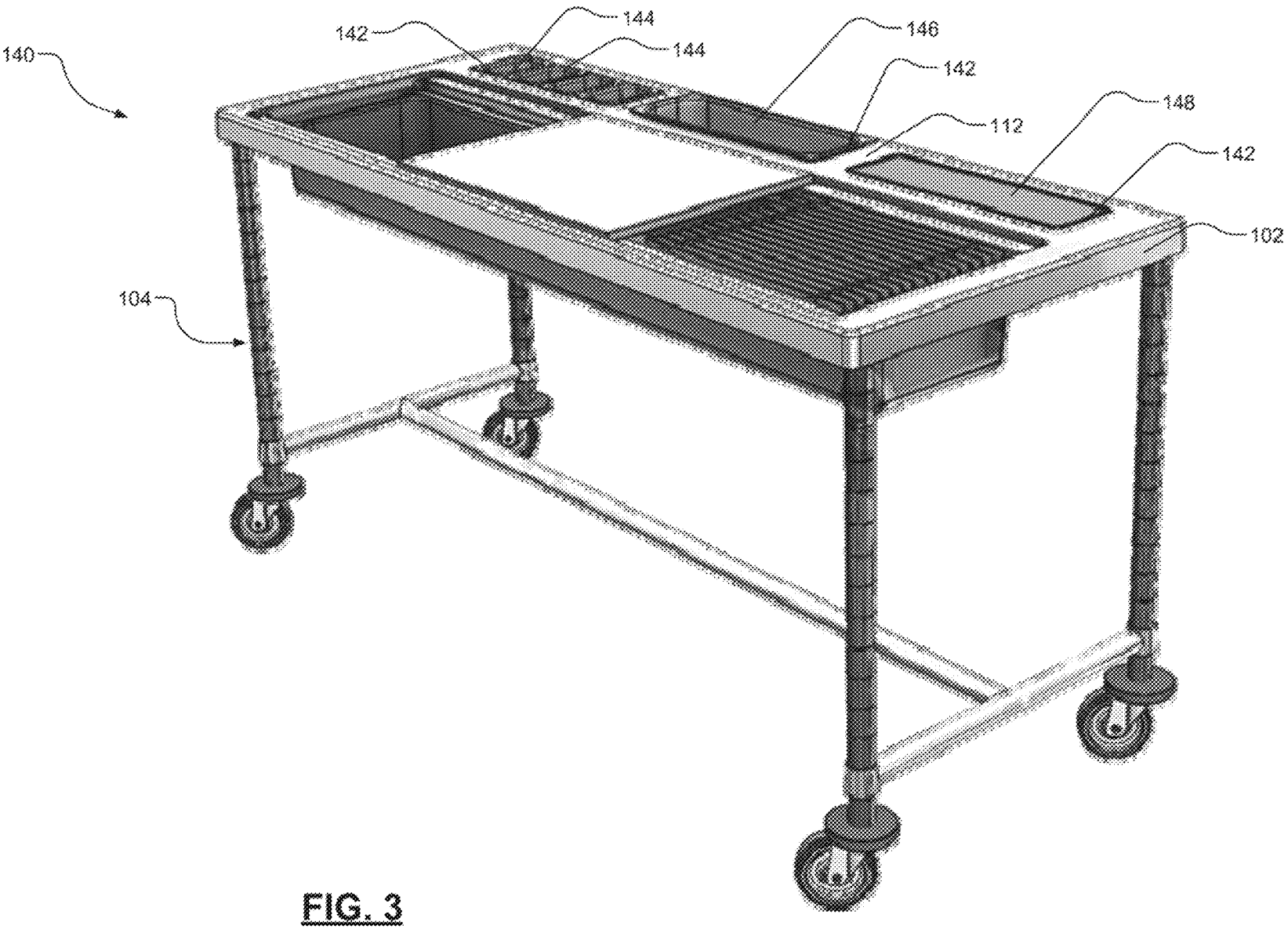
FIG. 3 is a perspective view of another example workstation in accordance with the present disclosure.

Referring now to FIG. 3, another example workstation is shown. In this example, a workstation 140 includes many of the previously described features including work platform 102, base 104 and work surface 112. In this example, however, the work surface 112 includes three apertures 142 into which various items of food service equipment are installed. The apertures 142 are rectangular in shape in this example and are spaced along the work surface 112. In other examples, the apertures 142 can have circular, square or other shapes. In addition, other examples can have more than three apertures 142 or less than three apertures 142.

The apertures 142 are sized to receive various pieces of food service equipment. As shown, a series of small pans 144 are inserted into the first aperture 142, a larger pan 146 is inserted into the middle aperture 142 and a plate 148 is inserted into the third aperture 142. The small pans 144, the larger pan 146 and the plate 148 include a flange that rests on the rim of the apertures 142 to support the small pans 144, the larger pan 146 and the plate 148 in the apertures 142. A portion of the pans 144, 146 can then extend through the apertures 142. The apertures 142 can support various types of food service equipment, including waste bins, other pans, storage bins, knife holders, utensil holders, dispensers, cutting boards and the like.

Figure 6:
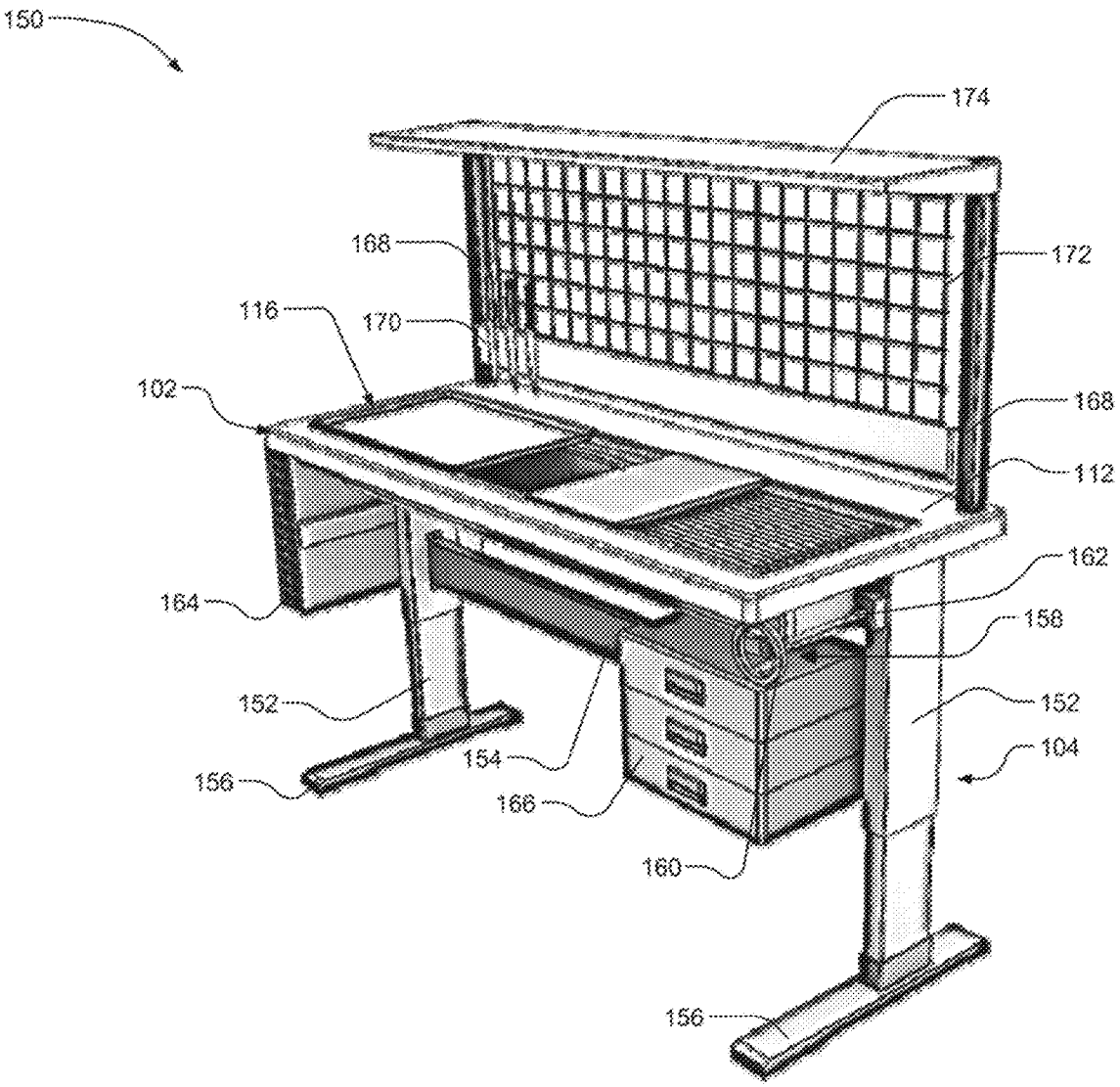
FIG. 6 is a perspective view of another example workstation in accordance with the present disclosure.

FIG. 6 shows another example embodiment of a workstation in accordance with the present disclosure. In this example, the workstation 150 includes many features as previously described including the work platform 102 with the multi-tiered receptacle 116 and the work surface 112. The base 104, in this example, includes a different structure than that previously described. In this example, the base 104 includes two telescoping supports 152. The telescoping supports 152 are positioned on each end of the work platform 102 and are connected by a beam 154 that is connected to and extends between the telescoping supports 152. A foot 156 is connected to the bottom of each telescoping support 152. The foot 156 projects in front of and behind the telescoping support 152 and assists in rigidly supporting the work platform 102 at a desired height above the floor. The telescoping supports 152 and the beam 154 have a rectangular cross-section in this example. In other examples, the telescoping supports 152 and the beam 154 can have circular, square or other suitable cross-sectional shapes.

As further shown, the workstation 150 includes a height adjustment mechanism 158. The height adjustment mechanism 158 permits a user to adjust the vertical height of the work platform 102. The work platform 102 can be adjusted from a vertical height suitable for working in a seated position to a vertical height suitable for working in a standing position. The height adjustment mechanism 158 can also adjust the vertical height of the work platform 102 such that the work platform 102 is positioned at a vertical height that is comfortable and ergonomically suitable for users of various heights.

The height adjustment mechanism 158, in this example, includes a wheel 160 and an axle 162. The wheel 160 is connected to the axle 162. The axle 162 projects into one of the telescoping supports 152 and is connected to a hydraulic piston, gear system or other adjustment system that converts the rotational input from a user into a vertical height adjustment of the work platform 102. The wheel 160 is positioned at one end of the work platform 102 at a location beneath the work platform 102. In this manner, a user can easily access the wheel 160 when standing at the workstation 150 to adjust the vertical height of the work platform 102.

Other types and configurations of height adjustment mechanism 158 can also be used. The height adjustment mechanism 158 can alternatively include a lever, knob, or other user input device to adjust the vertical height of the work platform 102. In other examples of workstation 150, the height adjustment mechanism can be a foot pedal or other device located at or near one of the feet 156. In still other examples, the height adjustment mechanism can be a switch, toggle, button or other device connected to an electrical control and/or motor that raises or lowers the work platform 102.

The workstation 150, in this example, also includes one or more items of storage, organization or food preparation equipment positioned below the work platform 102. As shown, the workstation 150 includes a storage rack 164 and a drawer system 166. The storage rack 164 is a rectangular box that includes a series of partitions. The partitions separate the storage rack 164 into slots that can receive trays, cutting boards, shallow pans or other items. The storage rack 164 can hold several such items where they can be dried or stored for later use. The storage rack 164 is connected to the bottom of the work platform 102 or to the outer surface of the telescoping support 152. In this position, the items stored in storage rack 164 can be easily accessed by a user.

The drawer system 166, in this example, is a rectangular box that includes three drawers. The drawer system 166 can be used to store ingredients, utensils, food preparation materials or other items. The drawer system can be connected to the bottom of the work platform 102, to the telescoping support 152 or to the beam 154.

The workstation 150 can include other storage equipment similar to the storage rack 164 and/or the drawer system 166. In other examples, the workstation 150 can include shelves, hooks, rods, bars, cubbies, bins or other storage equipment. Such additional or alternative storage equipment can be connected to the bottom of the work platform 102, to the telescoping support 152 or to the beam 154.

As shown in FIG. 6, the workstation 150 also includes two posts 168 that are connected to the work platform 102 and project upwards therefrom. The posts 168 are positioned toward the rear of the work platform 102 at or near the work surface 112. The posts 168 can be used to support other elements of the workstation 150. A cross member 170 is connected to the posts 168 and spans across the work platform 102. The cross member 170 is located adjacent the work surface 112 in this example but can be positioned at various vertical locations above the work platform 102. The cross member 170 has a rectangular cross section and has a magnetic surface on at least one face of the cross member 170. In this manner, the cross member can be used to retain knives or other ferrous utensils adjacent the work platform 102 within arm's reach of a user standing at the work station 150. The cross member 170 can have other cross sectional profiles as well and can include slots, holes, hooks, sleeves, compartments or other features to hold other food service equipment, food, ingredients and the like.

The workstation 150 can also include a wall 172 connected to the posts 168 as shown. In this example, the wall 172 is made of a wire mesh material such as a stainless steel wire mesh. The wall 172 can also include hooks, storage bins or other organizational items that are secured to the wire mesh. The repeating rectangular or square pattern on the wire mesh permits a user to orient, position and/or locate the organizational items on the wire mesh as desired. The organizational items can be removable so that the organizational items can be quickly and easily re-oriented and re-positioned as desired.

The wall 172 can also be made of other materials and in other configurations. The wall 172 can be a planar, smooth surface such as stainless steel sheeting or plastic. The wall 172 can also be a planar member with a series of holes, grooves or other retention features to which hooks, shelves, or other organization items can be secured.

The workstation 150 can also include shelf 174. In this example, the shelf 174 is positioned at the upper portion of posts 168 such that the shelf 174 spans across the work platform 102. The shelf 174 is a flat horizontal element. The shelf 174 projects outward from the posts 168 over the work platform 102. The shelf can include a light (not shown) that illuminates the work platform 102 or a vent fan (not shown). The shelf 174, in other examples, can have a different shape or can include grooves, holes, hooks, bins or cubbies to hold items of food service equipment, ingredients or other items.

Figure 7:
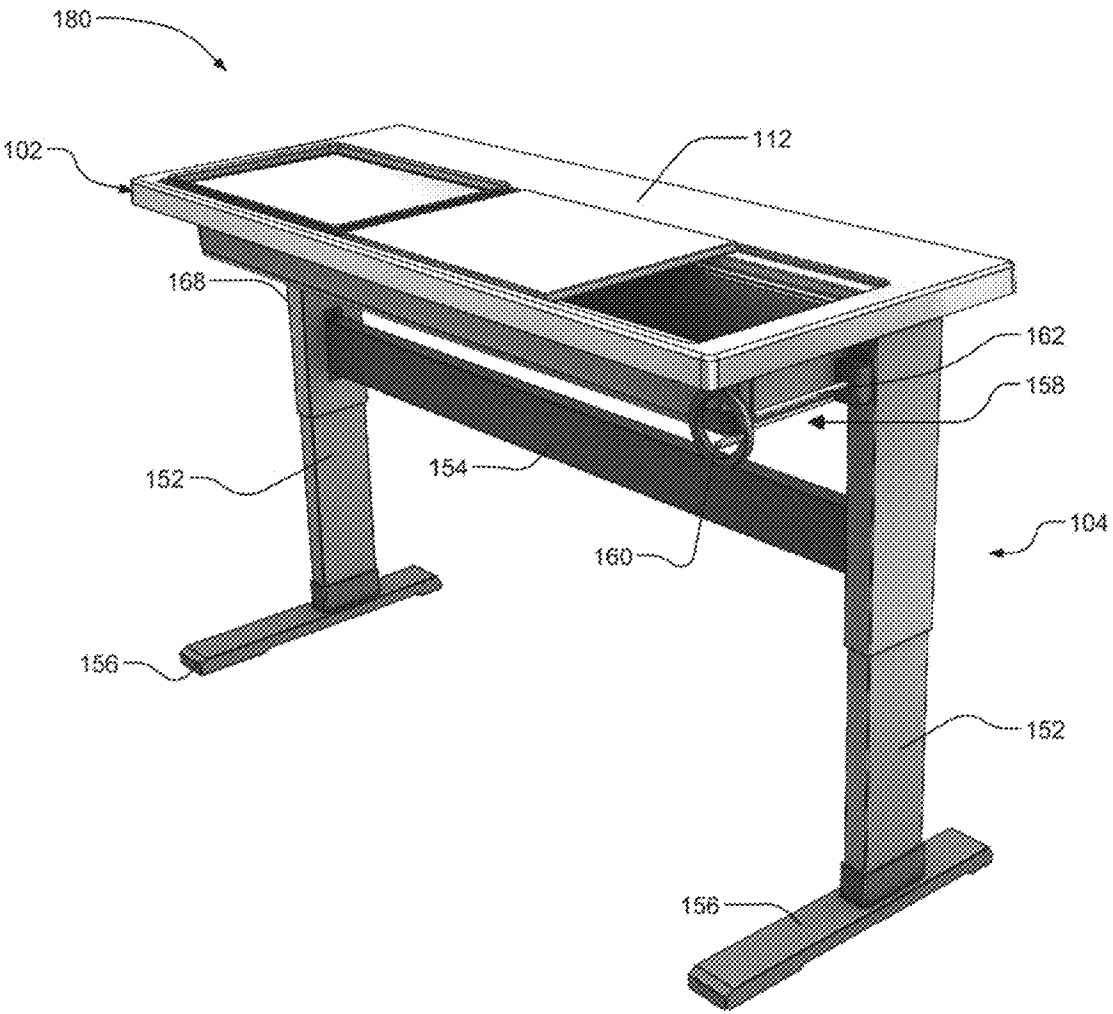
FIG. 7 is a perspective view of another example workstation in accordance with the present disclosure.

FIG. 7 shows another example workstation according to the present disclosure. The example workstation 180 is similar to the previously described workstation 150. The workstation 180 includes the work platform 102 and the base 104. The base 104, in this example, includes the two telescoping supports 152, the beam 154 and the height adjustment mechanism 158. The workstation 180 differs from workstation 150, however, in that it is a simplified version that does not include the storage rack 164, the drawer system 166, the posts 168, the cross member 170, the wall 172 or the shelf 174. As can be appreciated, the workstations of the present disclosure are configurable and modular systems in that the workstation can be used, configured and/or modified in a variety of configurations. The workstation can be assembled and used as shown in FIG. 7 as workstation 180 or can be assembled and used as shown in FIG. 6 as workstation 150. The workstations of the present disclosure are versatile food service preparation systems that can be used for a variety of purposes and in a variety of environments.

Figure 8:
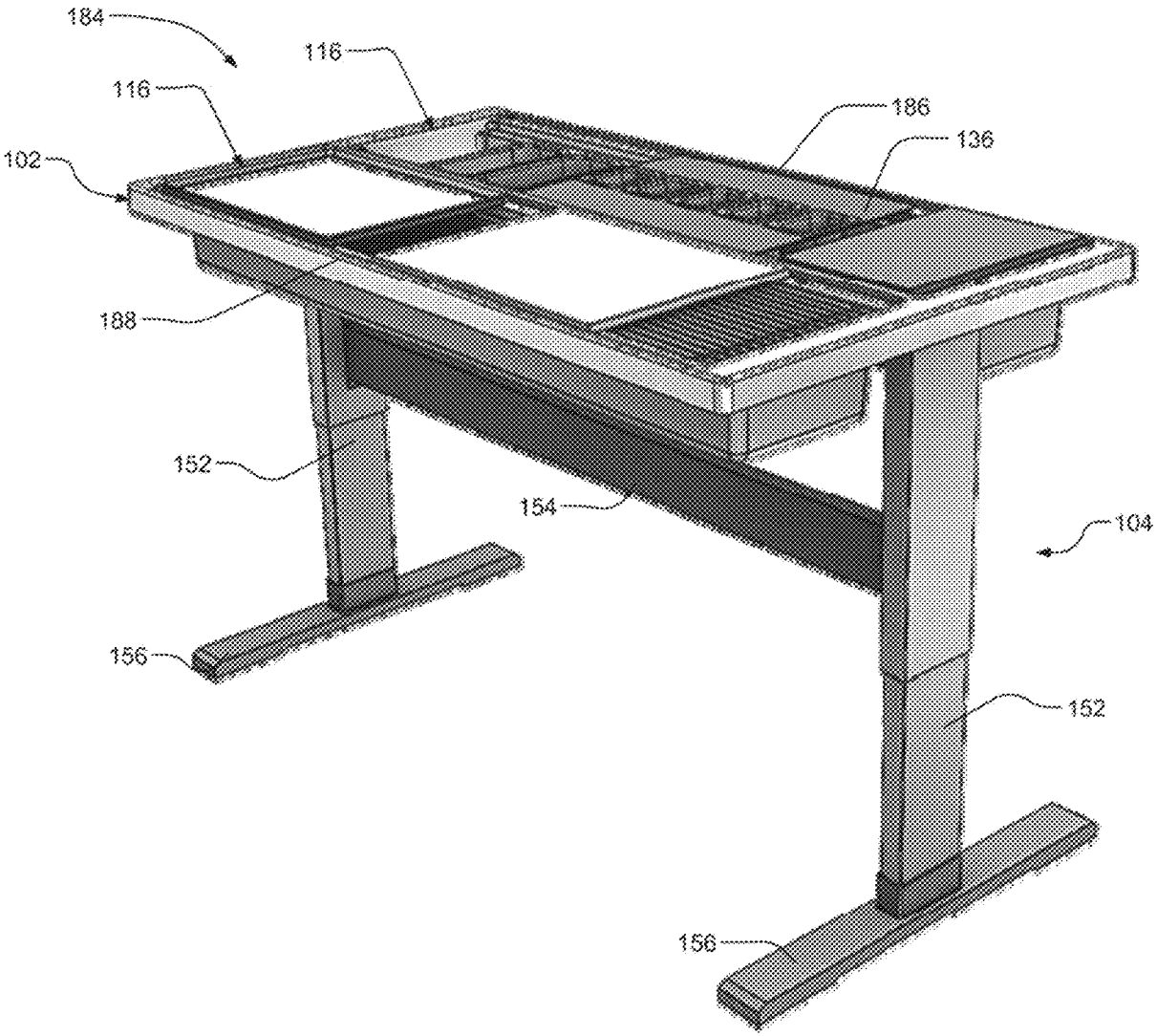
FIG. 8 is a perspective view of another example workstation in accordance with the present disclosure.

FIG. 8 shows yet another example embodiment of a workstation in accordance with the present disclosure. The workstation 184 is similar to the previously described workstations 150, 180. The workstation 184 includes a work platform 102 and a base 104. The base 104, in this example, includes telescoping supports 152 and beam 154. The work platform 102, in this example, is a two-sided work surface. The workstation 184 can be accessed and used from either a first side 186 or a second side 188. To accommodate this use, the work platform 102 extends outward from the telescoping supports 152 an equal amount on the first side 186 and on the second side 188. In this example, the work platform 102 includes two multi-tiered receptacles 116. The two multi-tiered receptacles 116 are positioned with one multi-tiered receptacle 116 adjacent the first side 186 and one multi-tiered receptacle 116 adjacent to the second side 188.

As can be appreciated, the two-sided workstation 184 permits a worker (or two workers) to work at either side of the work platform 102. As can be appreciated, the previously described elements can be included on the two-sided workstation 184. For example, the two-sided workstation 184 can include the posts 168, the cross member 170, the wall 172 and/or the shelf 174. In such an example, the posts 168 can be positioned at or near the center of the work platform 102 between the first side 186 and the second side 188. The wall 172 can be positioned between the first side 186 and the second side 188. The shelf 174, in such an example, can project outward from the posts 168 toward both the first side 186 and the second side 188. Such an example would create, generally speaking, two symmetrical workstations supported by the base 104.

Figure 9:
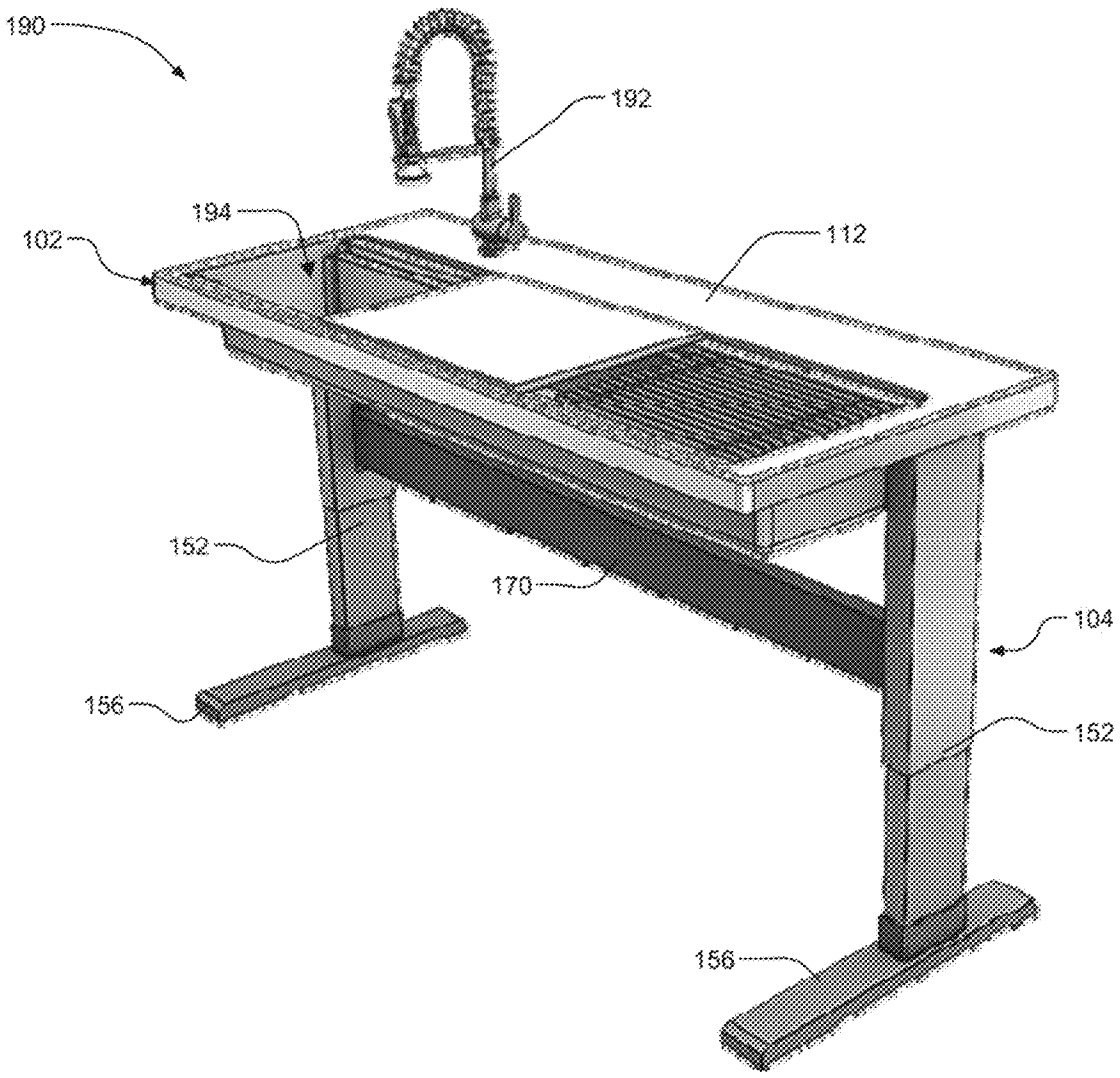
FIG. 9 is a perspective view of another example workstation in accordance with the present disclosure.
Figure 11:
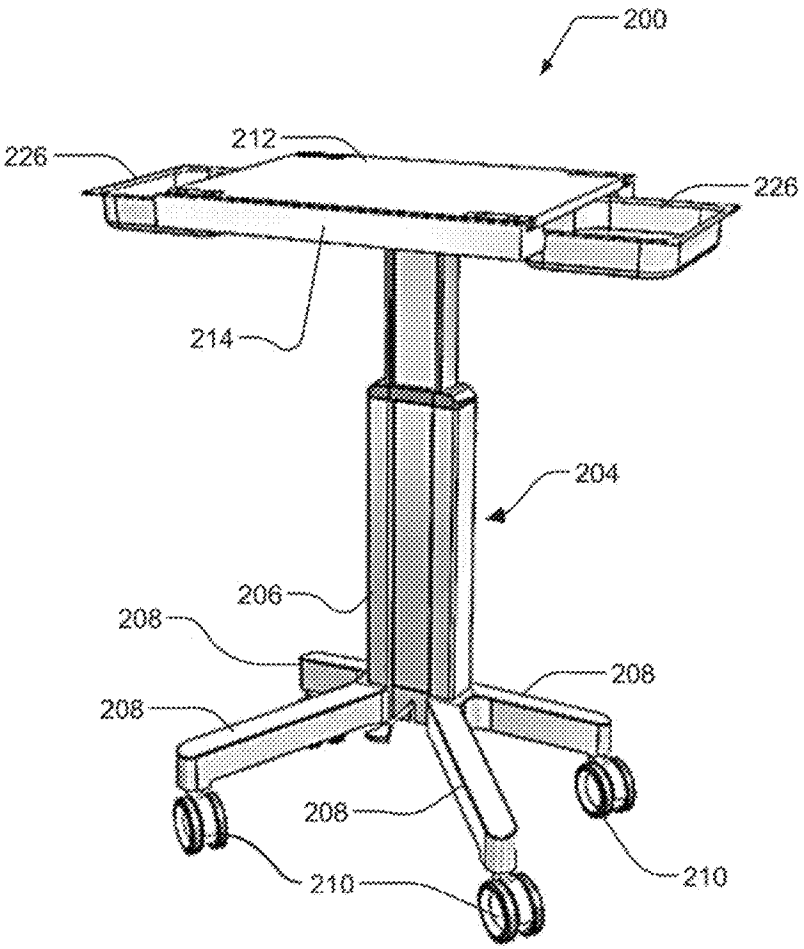
FIG. 11 is another view of the example workstation of FIG. 10 showing the pans in an extended position.

FIG. 9 shows yet another example embodiment of a workstation in accordance with the present disclosure. The workstation 190 is similar to the workstation 150. The workstation 190, in this example, includes a faucet 192 and a sink 194. The faucet 192 can be connected to a water source (not shown). The sink 194 can be vessel separate from the basin 132 of the multi-tiered receptacle 116. In other examples, the workstation 190 does not include a separate sink 194 and the basin 132 serves to catch and drain water that is dispensed from the faucet 192.

The previously described workstations, such as workstations 100, 140, 150, 180, 184 and 190 can include other elements not shown in the accompanying drawings. For example, the workstations can include heating or cooling elements in order to maintain food or ingredients at appropriate temperatures. A heating element can be included in a pan inserted in the multi-tiered receptacle 116 or installed in the basin 132. The heating element can be connected to an electrical or other power source to heat water in such a pan or in basin 132 to an elevated temperature. A cooling element can also be similarly located in the basin 132 or in a pan installed into the multi-tiered receptacle 116.

Figure 10:
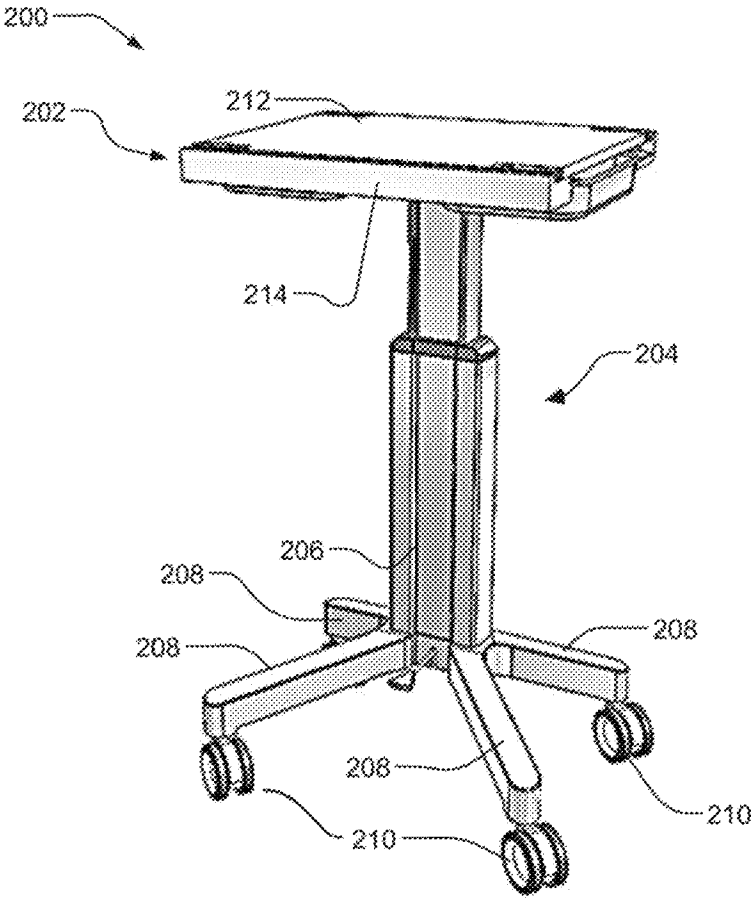
FIG. 10 is a perspective view of another example workstation in accordance with the present disclosure.

FIGS. 10-20 show another example embodiment of a workstation in accordance with the present disclosure. As shown in FIG. 10, the workstation 200 includes a work platform 202 and a base 204. The base 204 supports the work platform 202 at a desired vertical height. The base 204, in this example, includes support column 206. The support column 206 is a telescoping member that can adjust the vertical height of the work platform 202 as will be explained. One or more spokes 208 are connected to the bottom of the support column 206 and project outward from the support column 206 to stabilize the work station 200. The base 204 also optionally includes one or more casters 210 that are connected to each of the spokes 208. The casters 210 include wheels that permit the workstation 200 to be rolled to a desired location. In other examples of the workstation 200, the base 204 can have more than one support column 206 or can have a different configuration to support the work platform 202.

Figure 13:
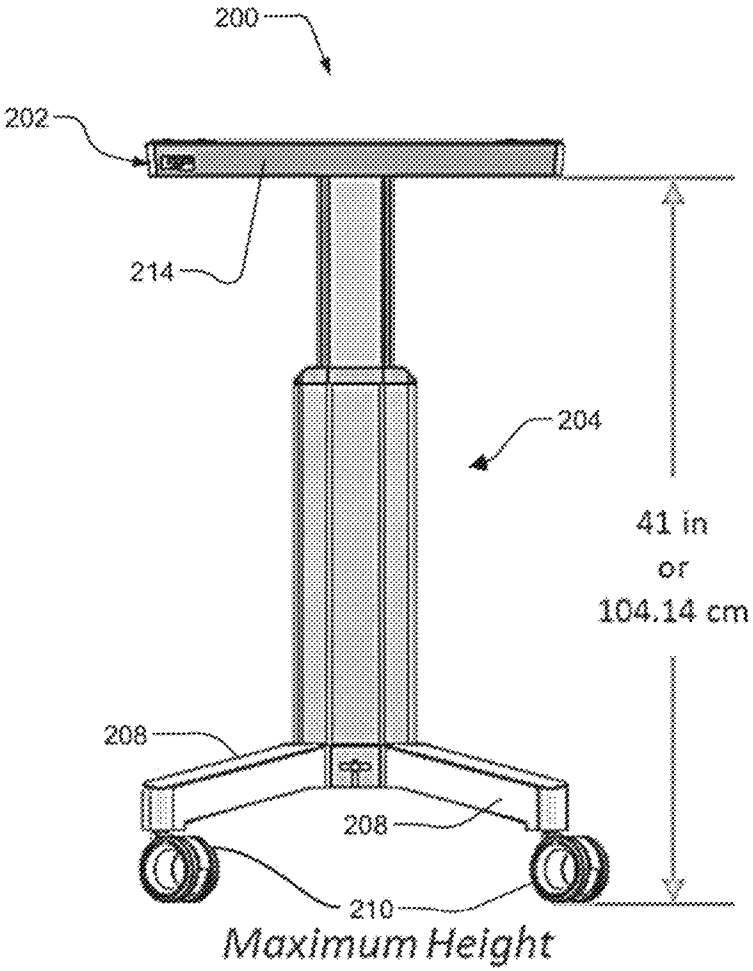
FIG. 13 is a front view of the example workstation of FIG. 10 showing the work platform at a maximum height position.
Figure 12:
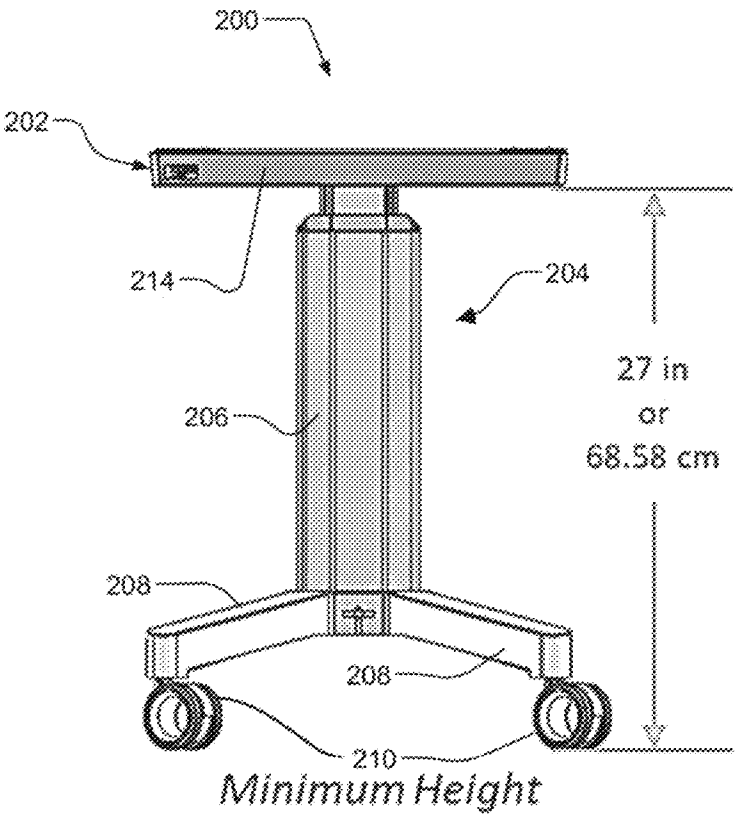
FIG. 12 is a front view of the example workstation of FIG. 10 showing the work platform at a minimum height position.

As previously stated, the support column 206 is a telescoping member that permits the work platform 202 to adjust to varying vertical heights. As shown in FIGS. 12 and 13, the work platform 202 can be adjusted from a minimum height in which the workstation 200 can be placed under a typical table or under a typical counter. The work platform 202 can also be adjusted to a maximum height in which the workstation 200 can be used by a user in a standing position. In the example shown, the work platform 102 can be adjusted from a vertical height of 27 inches to a vertical height of 41 inches. In other examples, the work platform 202 can be adjusted to different vertical heights.

Figure 15:
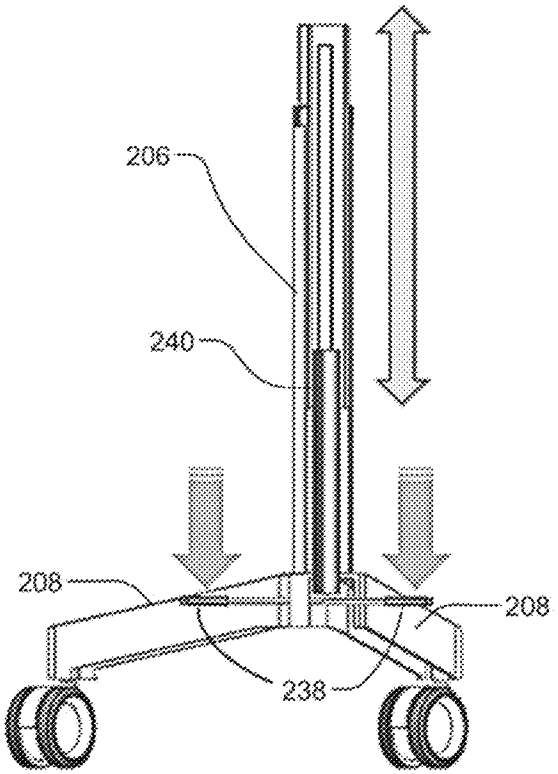
FIG. 15 is a cross-sectional view of the base of the example workstation of FIG. 10.
Figure 14:
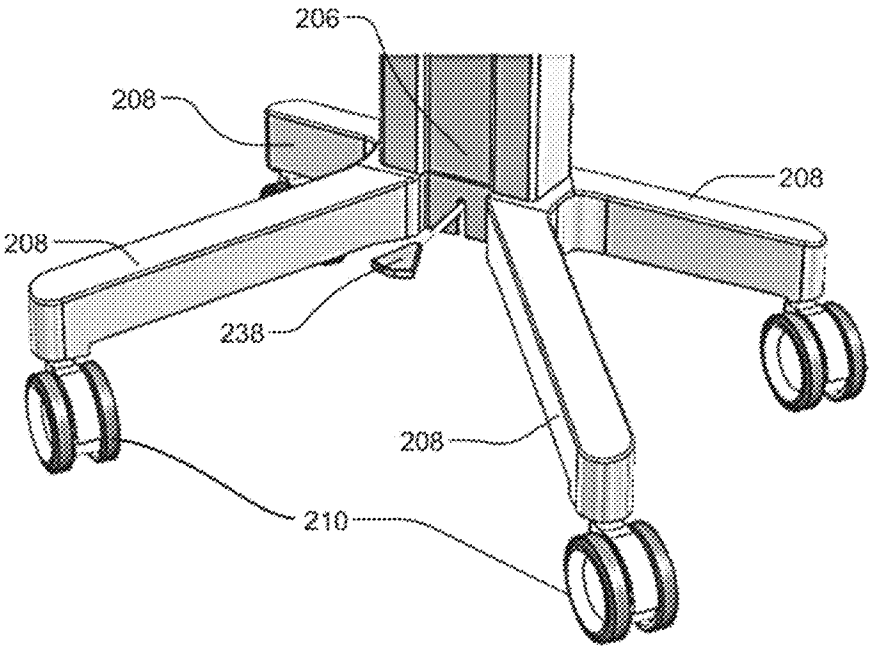
FIG. 14 is an illustration of a portion of the base of the example workstation of FIG. 10.

As shown in FIGS. 14 and 15, the base 204 can include a foot pedal 238. The foot pedal 238, in this example, projects outward from the support column 206 between two of the spokes 208. A user can actuate a telescoping mechanism 240 located inside the support column 206 to raise or lower the work platform 202. The telescoping mechanism 240 can be any suitable hydraulic piston cylinder. As further shown in FIG. 15, the base 204 can include two foot pedals 238 that project outward from two sides of the support column 206. In this configuration, the work platform 202 can be easily raised or lowered by actuating the foot pedal 238 from either side of the base 204.

The support column 206 of the workstation 200 can include features that permit shelves, compartments or other organizational or storage components to be attached to the column. For example, the support column can include flanges, hooks, holes, slots, grooves or other features. These features can be used to connect a shelf, storage compartment or other component to the support column. In other examples, shelves, storage compartments or other components can be connected to the support column 206 using fasteners or other suitable joining methods.

Referring back to FIG. 10, the work platform 202 includes a work surface 212 and a multi-tiered receptacle 214. The multi-tiered receptacle 214 is configured to receive one or more items of food service equipment and to hold such items in different horizontal planes. With such a configuration, the items of food service equipment can be moved relative to one another without interference.

Figure 16:
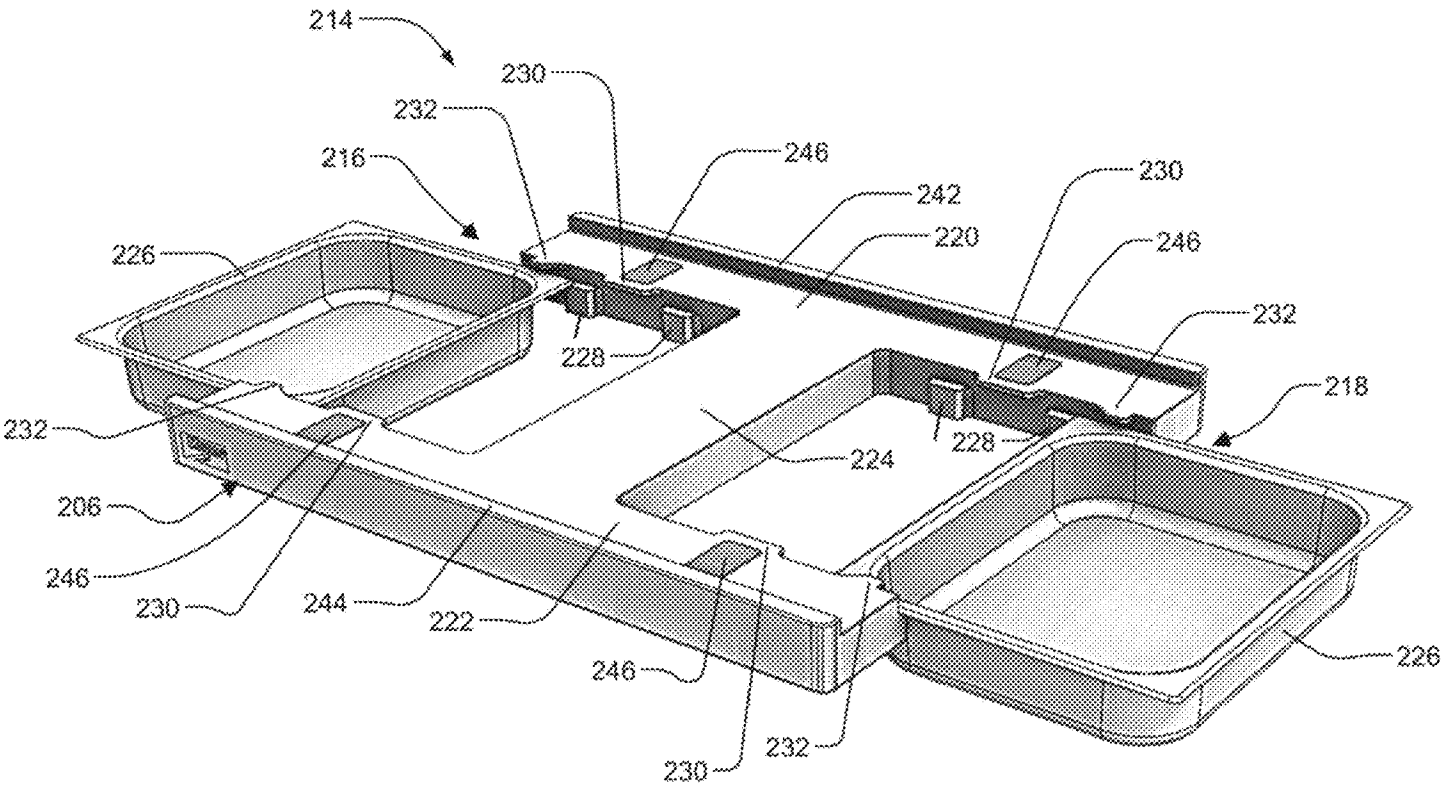
FIG. 16 is a perspective view of the multi-tiered receptacle of the example workstation of FIG. 10 with a work surface removed for clarity.

As shown in FIG. 16, the multi-tiered receptacle 214 includes a first slot 216 and a second slot 218. A pan 226 can be inserted and retained in the first slot 216 and/or the second slot 218. A first transverse portion 220 and a second transverse portion 222 are connected by a bridge portion 224 to define the first slot 216 and the second slot 218. The bridge portion 224 is positioned at the center of the work platform 202 between the first transverse portion 220 and the second transverse portion 222 such that the multi-tiered receptacle 214 has an H-shape.

The first slot 216 and the second slot 218 are sized so as to receive one or more standard sized U.S. or gastronorm pans. The pan 226 is inserted into the first slot 216 and/or the second slot 218 and is retained by one or more spacers 228, tabs 230 and fingers 232. As shown in FIG. 16, the spacers 228 are rectangular projections that project inward from the inward-facing wall of the first transverse portion 220. Similar spacers 228 (not shown) project inward from the inward-facing wall of the second transverse portion 222. In this example, two spacers 228 project from the first transverse portion 220 and two spacers project from the second transverse portion 222 in the first slot 216. As can be appreciated, the spacers 228 project inward such that the flange of the pan 226 rests on the top of the spacers 228 to keep the pan 226 supported in the vertical direction.

As further shown, the tabs 230 and the fingers 232 extend into the first slot 216. The tabs 230 extend from the first transverse portion 220 and the second transverse portion 222 into the first slot 216 between the bridge portion 224 and the end of the first slot 216. In this example, the tabs 230 are positioned at approximately the midpoint between the bridge portion 224 and the end of the first slot 216. The tabs 230 are separated from the spacers 228 such that the tabs 230 and the spacers 228 define a first track into which the pan 226 can be slid into the first slot 216. When the pan 226 is inserted into the first track, the pan can be moved in a transverse direction into and out of the first slot 218 but is limited from moving in a vertical direction by the spacers 228 and the tabs 230.

The multi-tiered receptacle 214 also includes fingers 232. The fingers 232 are similar to the tabs 230 in that they extend outward from the first transverse portion 220 and the second transverse portion 222 and into the first slot 216. The fingers 232 are positioned adjacent the end of the first slot 216. The fingers 232 further define the first track and limit the vertical movement of the pan 226 in the first slot 216.

The multi-tiered receptacle 214 includes a similar and symmetrical structure at the second slot 218. The tabs 230, the fingers 232 and the spacers 228 at the second slot 218 define a second track. The pan 226 can be inserted into the second track and is similarly retained in position. In the example shown, the first slot 216 and the second slot 218 are symmetric about the bridge portion 224. In other examples, the first slot 216 and the second slot 218 can have different shapes. For example, the first slot 216 can be larger than the second slot 218 so that a different size pan 226 fits in each of the first slot 216 and the second slot 218. In other examples, the first slot 216 and the second slot 218 can have different configurations to movably retain various items of food service equipment such as cutting boards, basins, waste bins, strainers and the like.

As previously discussed, the flange of the pan 226 rests on top of the spacers 230. In the example shown in FIG. 16, two spacers 230 are positioned along each of the inward-facing walls of the first transverse portion 220 and two spacers 230 are positioned along the second transverse portion 22 in the first slot 216. As such, the pan 226 can be pulled out and retained in the first track in at least three positions. In a first position, the pan 226 is inserted into the first slot 216 until the pan 226 abuts the bridge portion 224. In a second position, the pan 226 is pulled part-way out of the first slot 216. In the second position, the pan 226 is still supported by the spacers 230. If the pan 226 tilts such that the outward edge of the pan 226 moves downward, the pan 226 is held in position because the top the pan 226 contacts the tabs 230 and/or the fingers 232. In a third position, the pan 226 can be completely removed from the multi-tiered receptacle 214.

Figure 17:
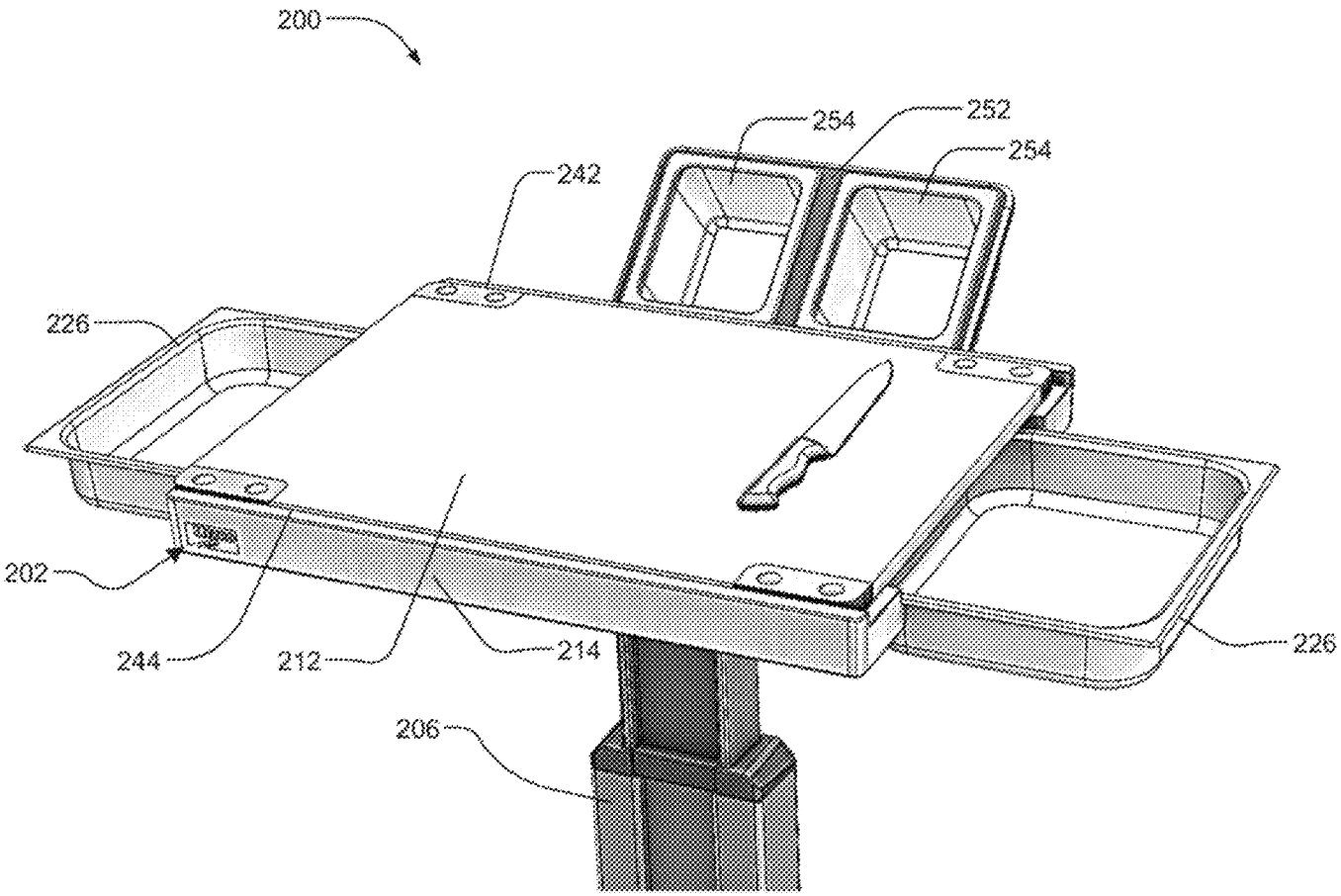
FIG. 17 is a perspective view of the example workstation of FIG. 10 including an exemplary storage accessory connected to the work platform.
Figure 19:
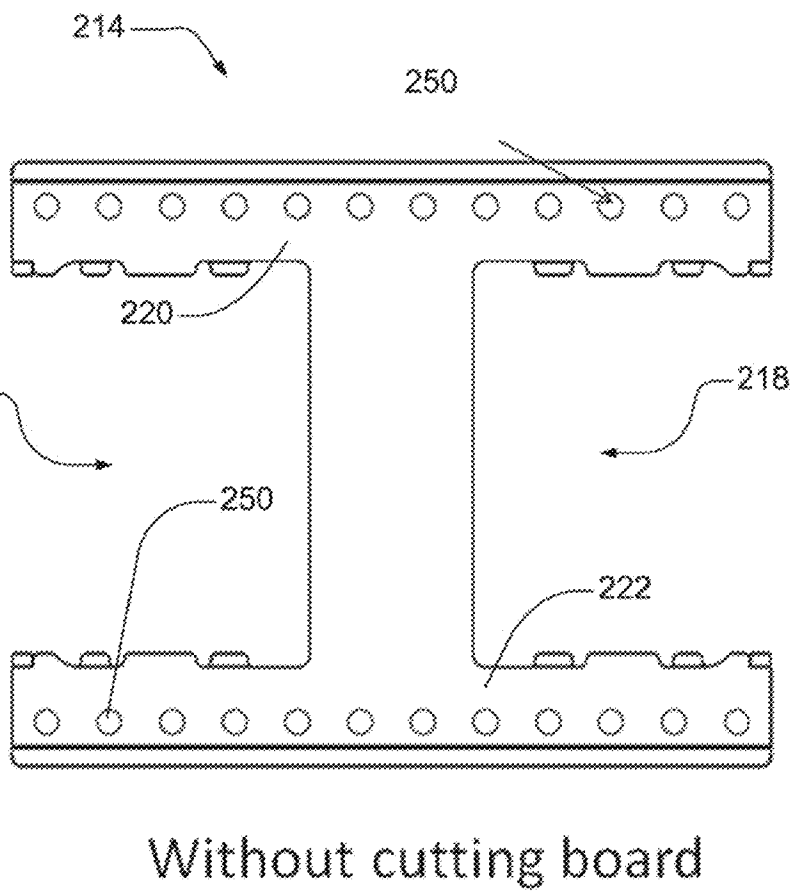
FIG. 19 is a top view of the multi-tiered receptacle of the example workstation of FIG. 10.

As shown in FIGS. 16 and 17, the work surface 212 can be placed on the multi-tiered receptacle 214. The multi-tiered receptacle 214 includes a first lip 242 and a second lip 244. The first lip 242 is a raised ridge that runs transversely across the multi-tiered receptacle 214. The second lip 244 is also a raised ridge and the second lip 244 runs along the opposite edge of the multi-tiered receptacle 214. The work surface 212 rests on the upper surface of the multi-tiered receptacle 214 between the first lip 242 and the second lip 244. In this position, the work surface 212 can slide along the multi-tiered receptacle 214 over the first slot 216 and the second slot 218 in a transverse direction but is limited from fore-aft movement by the first lip 242 and the second lip 244.

As shown in FIG. 17, the work surface 212 is a rectangular member. In the example shown, the work surface 212 is a cutting board. The work surface 212, in other examples, can be another item of food service equipment such as a food preparation station, a storage rack, container, or the like.

Figure 20:
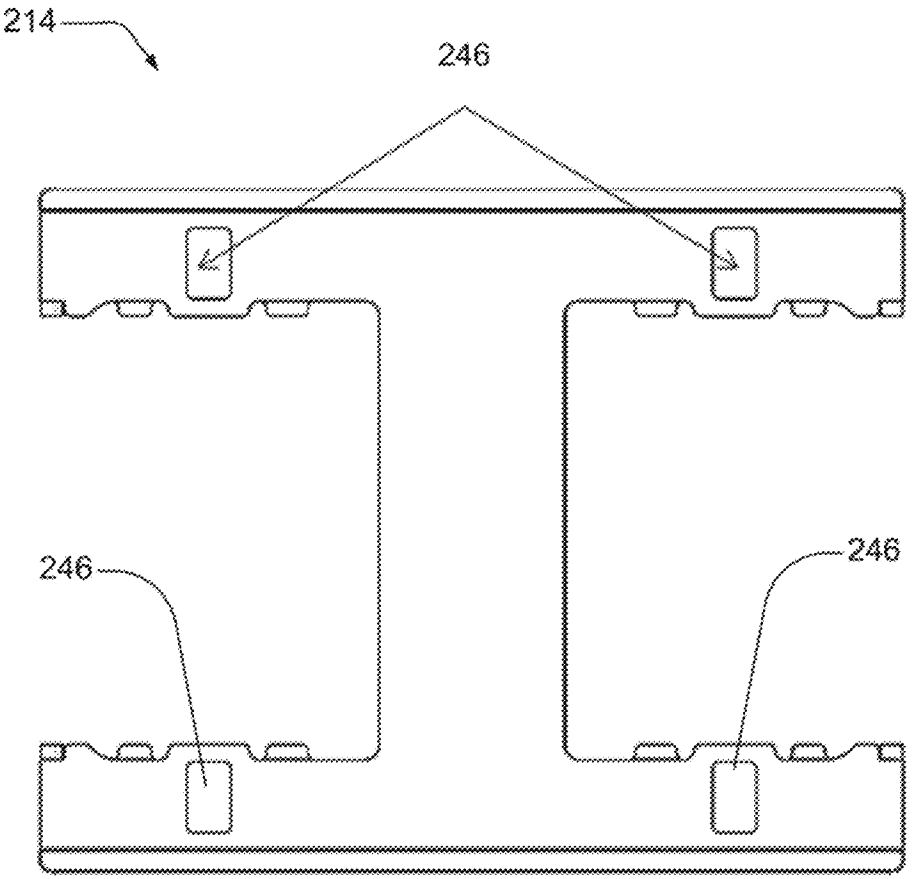
FIG. 20 is a top view of alternate multi-tiered receptacle that can be used with the example workstation of FIG. 10.

The multi-tiered receptacle 214 and/or the work surface 212 can have a friction or movement-limiting device or a feature that provides a tactile response when the work surface 212 is moved relative to the multi-tiered receptacle 214. In one example, as shown in FIGS. 16 and 20, the multi-tiered receptacle 214 can include one or more pads 246. The pads 246 are regions of material that reduce the likelihood of undesired movement of the work surface 212 relative to the multi-tiered receptacle 214. The pads 246, in one example, are co-molded into the multi-tiered receptacle 214 and are made of silicon. In other examples, the pads 246 can be separately formed and then connected to the multi-tiered receptacle 214 by a suitable joining technique such as by adhesive, welding, staking or the like. In addition, the pads 246 can be made of other materials with suitable frictional properties such as thermoplastics, rubbers or the like.

The pads 246 can be slightly raised above the top surface of the multi-tiered receptacle 214 such that the work surface 212 can rest on the pads 246 without contacting the entire top surface of the multi-tiered receptacle 214. As shown in the example of FIGS. 16 and 20, the multi-tiered receptacle 214 includes four pads 246. Two pads 246 are located adjacent the tabs 230 on the first transverse portion 220 and two pads 246 are located adjacent the tabs 230 on the second transverse portion 222. In other examples, other quantities and arrangements of the pads 246 can also be used.

The pads 246, in another example, can be positioned at one or more positions relative to the first transverse portion 220 and/or the second transverse portion 222. The pads 246, in such an example, can be raised and lowered such that the top surfaces of the pads 246 are raised above the top surfaces of the first transverse portion 220 and/or the second transverse portion 222 when the pads 246 are in a first (or raised) position. In a second (or recessed) position, the top surfaces of the pads 246 are positioned below the top surfaces of the first transverse portion 220 and/or the second transverse portion 222. As can be appreciated, when the pads 246 are in the first (or raised) position, a cutting board (or other work surface 212) that is positioned on the multi-tiered receptacle 214 contacts the pads 246. The contact between the cutting board (or other work surface 212) and the pads 246 inhibits movement of the cutting board (or other works surface 212)

relative to the multi-tiered receptacle 214 due to the increased friction. Conversely, when the pads 246 are in the second (or recessed position), the cutting board (or other work surface 212) positioned on the multi-tiered receptacle 214 is permitted to freely slide along the first transverse portion 220 and the second transverse portion 222 because the cutting board (or other work surface 212) does not contact the pads 246 in the recessed position. In other examples, the pads 246 can have other positions, can be move independently from one another or operate in multiple different raised positions in order to change the amount friction restricting undesired movement of the work surface 212.

Figure 18:
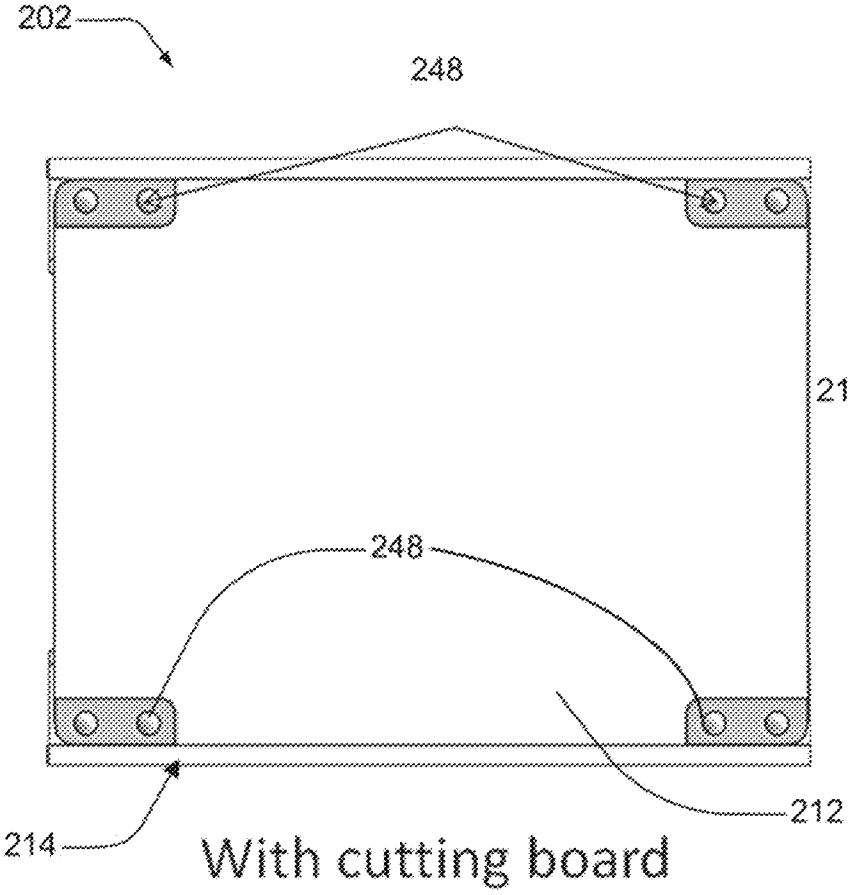
FIG. 18 is a top view of the example workstation of FIG. 10.

In another example of the work platform 202, the work surface 212 includes one or more projections 248 and the multi-tiered receptacle 214 includes one or more complimentary recessed dimples 250. As shown in FIGS. 17 and 18, the work surface 212 (e.g., a cutting board) can include a pair of projections 248 at or near each corner of the work surface 212. The projections 248 are arranged such that they fit into a corresponding series of dimples 250 that are located in a line along the first transverse portion 220 and the second transverse portion 222. The work surface 212, with the projections 248, is rested on the multi-tiered receptacle 214 such that the projections nest inside the dimples 250. As can be appreciated, the work surface 212 can be moved transversely along the multi-tiered receptacle 214 so that the work surface 212 can be indexed and retained in a desired indexed position by the nesting of the projections 248 inside the dimples 250. This nesting does not prevent the work surface 212 from all movement but can resist undesired movement that could otherwise occur if a user is utilizing the work surface 212 for food preparation. In this manner, the user has controlled movement of the work surface 212 and can move the work surface 212 along the multi-tiered receptacle 214 when such movement is desired.

In other examples, the arrangement of the dimples 250 and the projections 248 can be reversed. In such other examples, the work surface 212 can include the dimples 250 and the multi-tiered receptacle 214 can include the projections 248. In still further examples, other complimentary or nesting structures can be used to prevent undesired movement of the work surface 212 relative to the multi-tiered receptacle 214. For example, grooves with mating ribs, holes with mating pegs or other types of structures can be used.

The workstation 200 can also include other accessories, additional storage and/or additional organization attachments. As shown in FIG. 17, the workstation 200 can include hopper 252. The hopper 252 is an angled storage structure that can be connected to the multi-tiered receptacle 214. In one example, the hopper 252 includes a flange that is configured to engage the first lip 242 or the second lip 244. In these examples, the flange on the hopper 252 hooks over the first lip 242 and can be easily engaged and disengaged from the work platform 202. In other examples, the hopper 252 (or other attached accessories) can be secured to the multi-tiered receptacle 214 using other mating features such as hooks, holes and pegs, grooves and ribs or the like.

The hopper 252, in the example shown, extends outward and upward from the multi-tiered receptacle 214 such that the storage bins 254 located in the hopper 252 are accessible to a user. The contents of the storage bins 254 can be easily moved from the storage bins 254 to the work surface 212 or to the pans 226. In this example, the hopper 252 includes two storage bins 254. In other examples, the hopper 252 can include more or less than two storage bins. The hopper can also include one or more openings appropriately sized to receive U.S. or gastronorm sized pans. The workstation 200 can also include shelves, spice racks, hooks, bars, racks or other organization or storage accessories.

FIGS. 21-27 show another example workstation of present disclosure. An example workstation 300 includes a work platform 302, a hopper 304 and a base 306. The work platform 302, as will be described further below, is a configurable, modular assembly that provides a work surface and storage compartments. The work platform 302 is movable and assists a worker in quickly and efficiently processing food or performing other assembly and food service tasks. The hopper 304 is attached to the work platform 302 and provides additional storage compartments for ingredients, food items, utensils, cleaning supplies and the like. The base 306 is connected to the work platform 302 and supports the work platform 302 at a desired height and position.

As shown, the base 306, in this example, includes a support column 308, spokes 310, casters 312 and foot pedal 314. The support column 308, in this example, has a square or rectangular hollow cross-section and includes a first portion 316 and a second portion 318. The first portion 316 and the second portion 318 nest inside one another such that the first portion 316 and the second portion 318 can telescopically slide inside one another to adjust the overall height of the support column 308. In this manner, the height of the work platform 302 can also be adjusted according to the preferences of a worker.

While not shown, the support column 308 can include a linearly-extensible height adjustment device (e.g., a gas spring) located inside the hollow inner chamber of the support column 308. The gas spring can be coupled to the foot pedal 314. The foot pedal 314, in such an example, can be used to cause the gas spring to extend or retract in length and oppose the weight of the work platform 302 (and any items placed thereon). As such, the gas spring can assist a worker in raising or lowering the work platform 302. The worker can actuate the gas spring by depressing the foot pedal 314 and then raising or lowering the work platform 302 by pulling up or pushing down on the work platform 302.

The foot pedal 314, in this example, is located between two of the spokes 310 at the lower portion of the base 306. The spokes 310 are elongated structures that project outward from the support column 308 to support the workstation 300. The spokes 310 project outward to provide a stable support structure for the workstation 300 and project outward a suitable distance such that the workstation 300 is not susceptible to tipping when the workstation is loaded with food items, ingredients and the like. The casters 312 are rotatably connected to the ends of the spokes 310. The casters 312 permit the workstation to be rolled to a desired location and then be rolled to different locations for cleaning, storage or other uses. As shown in this example, the workstation 300 includes four spokes 310 that are joined at a center portion 320. The center portion 320 and the spokes 310 can be molded or otherwise formed as a single piece as shown or can be separate pieces that are connected together. The center portion 320 has a suitable structure to securely mount the spokes 310 to the support column 308. In other examples, the workstation 300 can have more or less than four spokes 310 and can be connected to the support column 308 using other suitable connection structures.

The work platform 302, in this example, is connected to the top of the support column 308. The work platform 302 includes a work surface 322, a first rail 324, a second rail 326, a pan 328, a cradle 330 and a handle 332. The work surface 322, in this example, is a removable planar member that spans across the top of the work platform 302. The work surface 322 provides a suitable surface for performing food service related tasks such as cutting, cleaning, or other food preparation tasks. In one example, the work surface 322 is a cutting board that can be flipped over, slid or otherwise moved on the work platform 302 as desired by the worker.

The work platform 302 is supported in a horizontal position on the workstation 300 by the first rail 324 and the second rail 326. The first rail 324 and the second rail 326 are configured similarly to one another and positioned such that the first rail 324 and the second rail 326 are symmetrically opposite to one another in a longitudinal direction along the workstation 300.

Figure 23:
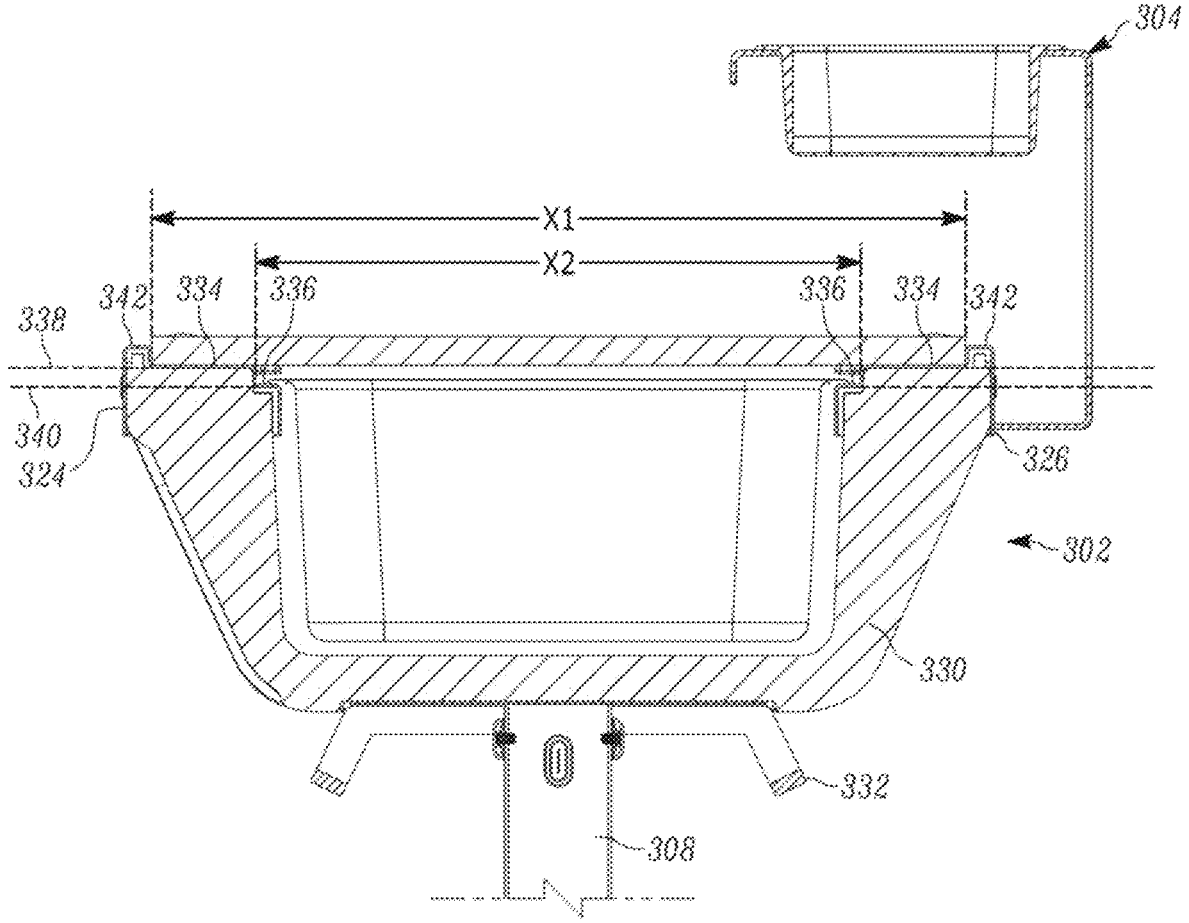
FIG. 23 is a sectional view of the example workstation of FIG. 21.

The first rail 324 and the second rail 326 create a multi-tiered structure in the work platform 302. As shown in FIG. 23, the first rail 324 and the second rail 326 each include a first support surface 334 and a second support surface 336. The first support surface 334 and the second support surface 336 are horizontal walls that extend longitudinally along the first rail 324 and the second rail 326. The first support surface 334 is vertically spaced apart from the second support surface 336.

The first support surface 334 of the first rail 324 and the first support surface 334 of the second rail 326 establish a first platform 338. The first platform 338 creates a support surface to support the work surface 322. The first platform 338 has a width X1 that is the slightly larger than a width of the work surface 322. In this manner, the work surface 322 can be placed in (and removed from) the first platform 338. The first rail 324 and the second rail 326 also include ridges 342 that project upward from the first support surfaces 334. The ridges 342 are positioned outward of the first support surfaces 334. As such, the ridges 342 limit the work surface 322 from moving in a fore-aft direction on the work platform 302.

As further shown in this example, the second support surfaces 336 of the first rail 324 and the second rail 326 establish a second platform 340. The second platform 340 supports the pan 328. The pan 328 can be any suitable receptacle or other storage bin such as a U.S. or gastronorm sized food container. As shown, the second platform 340 has a width X2 that is larger than a width of the pan 328. As such, the pan 328 can be inserted into, slid along or removed from the second platform 340.

As further shown, the first platform 338 and the second platform 340 are vertically spaced apart from one another. In this example, the first platform 338 is positioned above the second platform 340. In this configuration, food items that are prepared, cut, cleaned or otherwise manipulated on the work surface 322 can be easily moved into the pan 328 by sliding such food items into the pan 328. As can be appreciated, the work surface 322 and the pan 328 can be moved relative to one another along the first rail 324 and the second rail 326.

Figure 24:
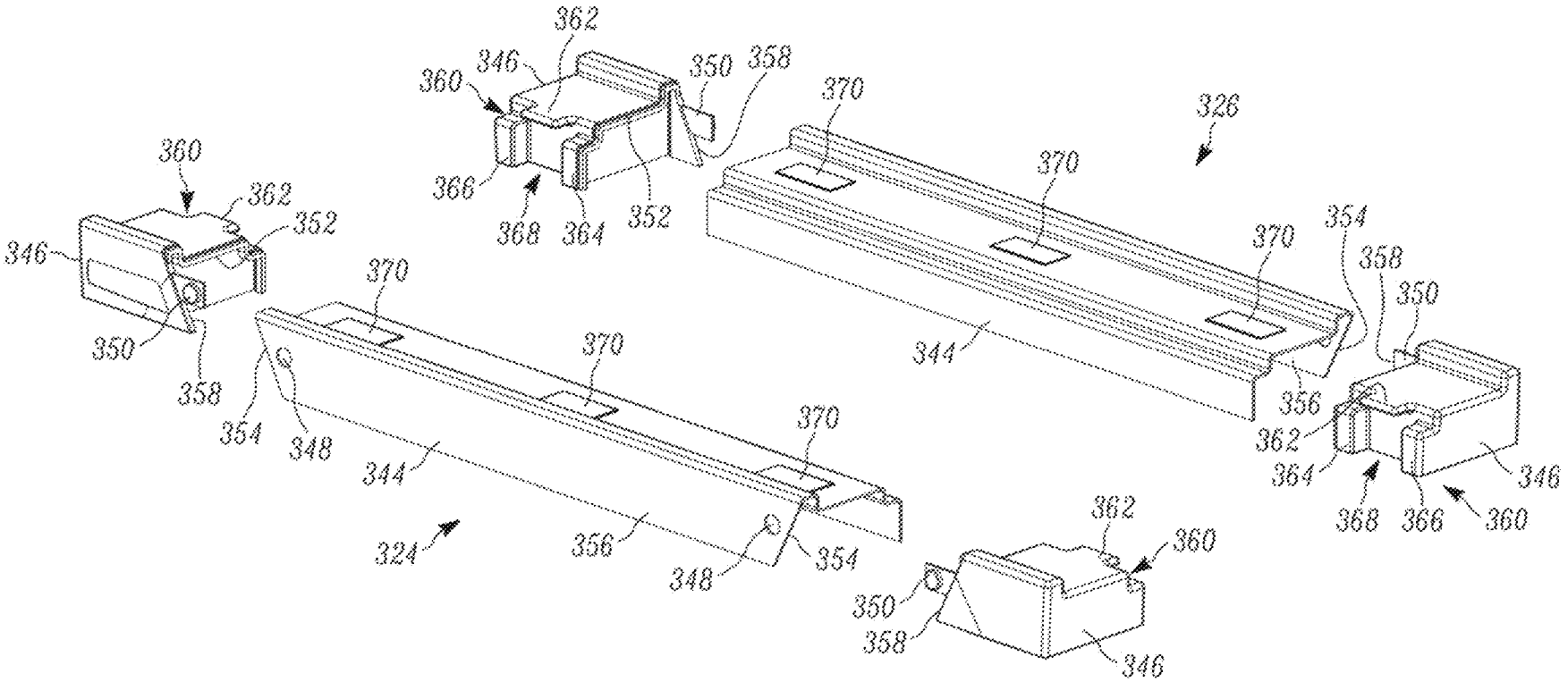
FIG. 24 is an exploded view of the rails and endcaps used in the example workstation of FIG. 21.

Referring now to FIG. 24, the first rail 324 and the second rail 326 can each include a longitudinal section 344 and two endcaps 346. In this example, the endcaps 346 can be secured to and removed from the longitudinal section 344. This type of configuration can be useful in order to easily clean the first rail 324 and the second rail 326. In the example shown, the endcaps 346 are made of a plastic material and the longitudinal section 344 is extruded or formed of a metal such as stainless steel or aluminum. In this configuration, the endcaps 346 can be removed from the longitudinal section 344 and can be easily cleaned by inserting the endcaps 346 into a suitable automatic dishwashing apparatus or by manual washing. In other examples, the first rail 324 and the second rail 326 can be molded or formed as a single piece. The first rail 324 and the second rail 326 (including the longitudinal section 344 and/or the endcaps 346) can be made of other suitable metals, plastics or composites.

In the example shown, the longitudinal sections 344 include apertures 348 that are positioned toward the ends of the longitudinal section. The endcaps 346 include retention tabs 350 with complimentary projections that are sized to project through the apertures 348. In this example, the apertures 348 and the projections on the retention tabs 350 are circular. In other examples, the apertures 348 and/or the projections on the retention tabs 350 can have other suitable shapes or profiles.

The endcaps 346 have cross-sectional profiles that match the cross-sectional profile of the longitudinal section 344. The endcaps 346 include an attachment flange 352. The attachment flange 352 has a similar cross-sectional profile but the size of the attachment flange 352 is slightly smaller than the size of the cross-sectional profile of the longitudinal section 344. In this manner, the attachment flange 352 nests inside the longitudinal section 344. When the attachment flange 352 nests inside the longitudinal section 344, the retention tab 350 engages the aperture 348 to retain the endcap 346 to the longitudinal section 344. As can be appreciated, the endcap 346 can be easily removed for cleaning by depressing the retention tab 350 at the aperture 348 and pulling the endcap 346 from the longitudinal section 344.

Figure 21:
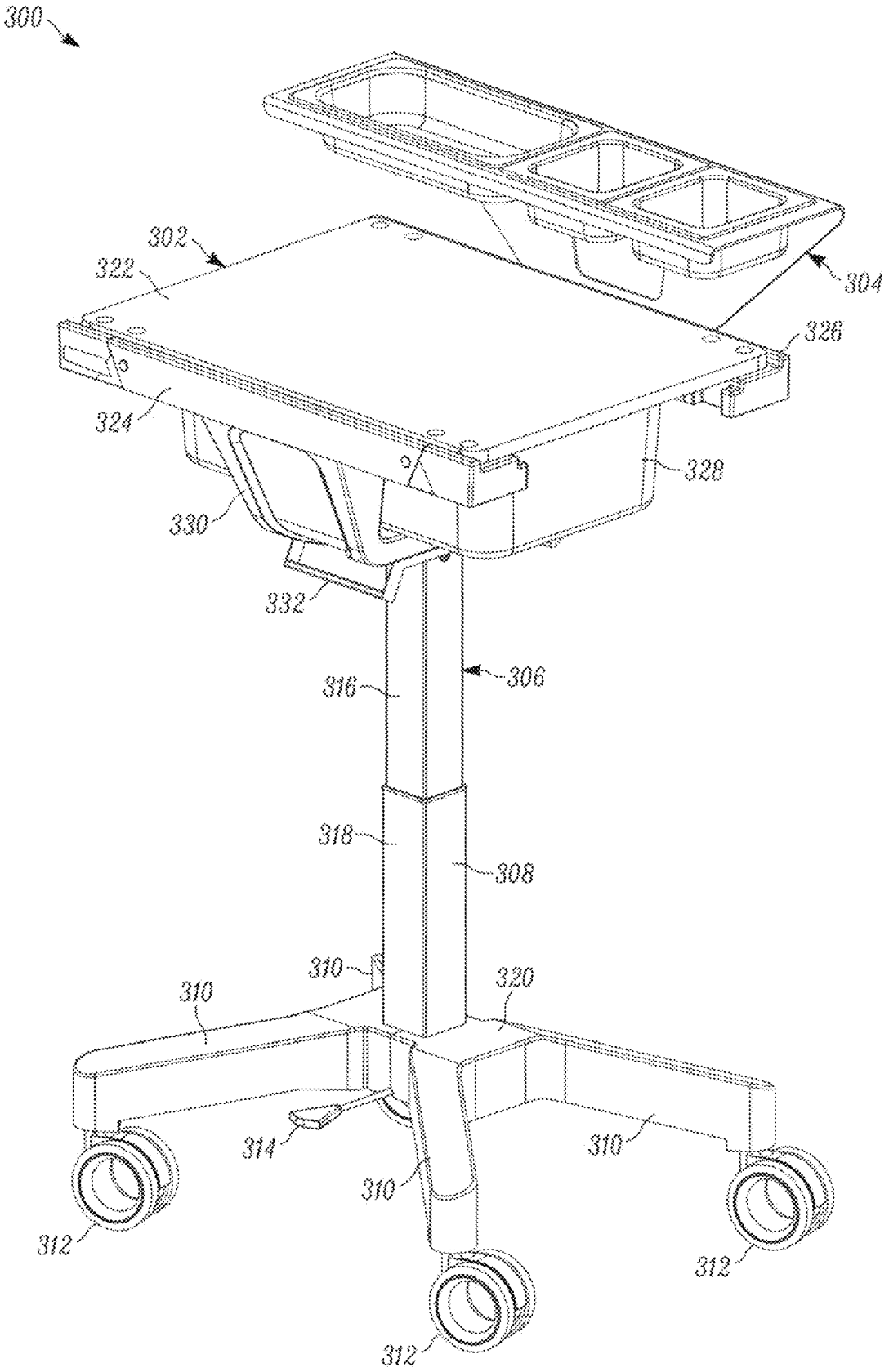
FIG. 21 is a perspective view of another example workstation in accordance with the present disclosure.
Figure 21A:
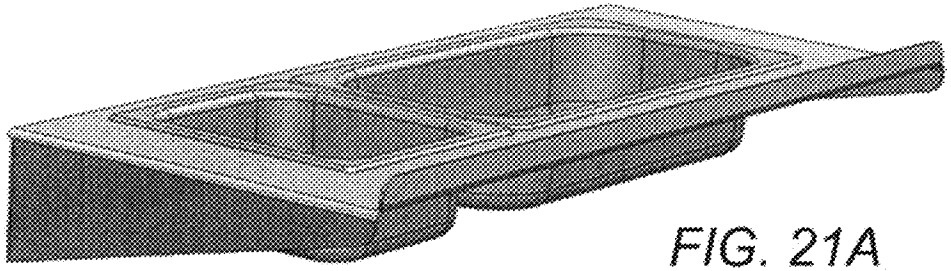
FIGS. 21A and 21B show perspective views of exemplary storage accessories for use with the workstation of FIG. 21.

As further shown in FIGS. 21 and 24, the longitudinal section 344 includes an angled edge 354 at the ends of the outer wall 356. The angled edge 354 angles from the ridge 342 toward the center of the longitudinal section 344. The endcaps 346 have a similar angled mating wall 358 that follows the same angle as the angled edge 354 of the longitudinal section 344. When the endcaps 346 are secured to the longitudinal sections 344, the mating walls 358 of the endcaps abut the angled edges 354 of the longitudinal sections 344. With this configuration, the endcaps 346 are securely supported from the downward forces that are exerted by the pan 328 and/or the work surface 322.

As further shown in FIG. 24, the endcaps 346 include a friction and/or gravity retention feature 360. The retention feature 360 prevents the pan 328 from falling out of the workstation 300. As shown, the retention feature 360 includes a top projection 362, a first brace 364 and a second brace 366. The top projection 362 projects inward from the longitudinal direction of the first rail 324 or the second rail 326. The top projection 362 projects inward from the first support surface 334 in the same plane as the first platform 338. The top projection 362 has a thickness that causes the top projection 362 to be spaced above the pan 328 when the pan 328 is received in the second platform 340.

The first brace 364 and the second brace 366 are formations in the endcaps 346 that are in the same plane as the second support surface 366. The first brace 364 and the second brace 366 are longitudinally spaced apart from one another by a gap 368. The top projection 362 is positioned such that it is located above the gap 368. When the pan 328 is inserted into or removed from the workstation 300 by sliding the pan 328 on the second platform 340, the flanges of the pan 328 slide between the top projection 362 and the first and second braces 364, 366.

The retention feature 360 can prevent the pan 328 from falling out of the workstation 300. As a worker removes or slides the pan 328, such that the pan 328 moves longitudinally along the second platform 340, the pan 328 projects outward from the edge of the work platform 302. If a worker loses a grip on the pan 328 or the pan 328 is released, the weight of the pan 328 (and the weight of the items that may be contained in the pan 328) causes the pan 328 to rotate downward. When such rotation occurs, the pan 328 would contact the top projection 362 to limit such rotation. The bottom of the pan 328 is still supported by the first brace 364 and/or the second brace 366. As such, the pan 328 can be "pinched" between top projection 362 and the first brace 364 and/or the second brace 366. This "pinching" can limit further rotation of the pan 328 and prevent the pan 328 from falling out of the workstation 300.

As further shown in FIGS. 21 and 24, the first rail 324 and/or the second rail 326 can include pads 370. As previously described, the pads 370 can be one or more locations on the first rail 324 and/or the second rail 326 that increase the frictional force between the work surface 322 and the first rail 324 and/or the second rail 326. The pads 370 can be made of silicone or other elastomeric material that has a higher coefficient of friction than the first rail 324 and/or the second rail 326. The pads 370 can be raised above the first platform 338 such that the pads contact a bottom of the work surface 322 when the work surface is positioned in or moved relative to the first rail 324 and the second rail 326. In some examples, the pads 370 can be raised or lowered relative to the first platform 338. In other examples, the pads 370 are over-molded into the first rail 324 and/or the second rail 326. In still other examples, the pads 370 can be removable from the first rail 324 and/or the second rail 326. It may be desirable that the pads can be removable for cleaning or other purposes.

Figure 25:
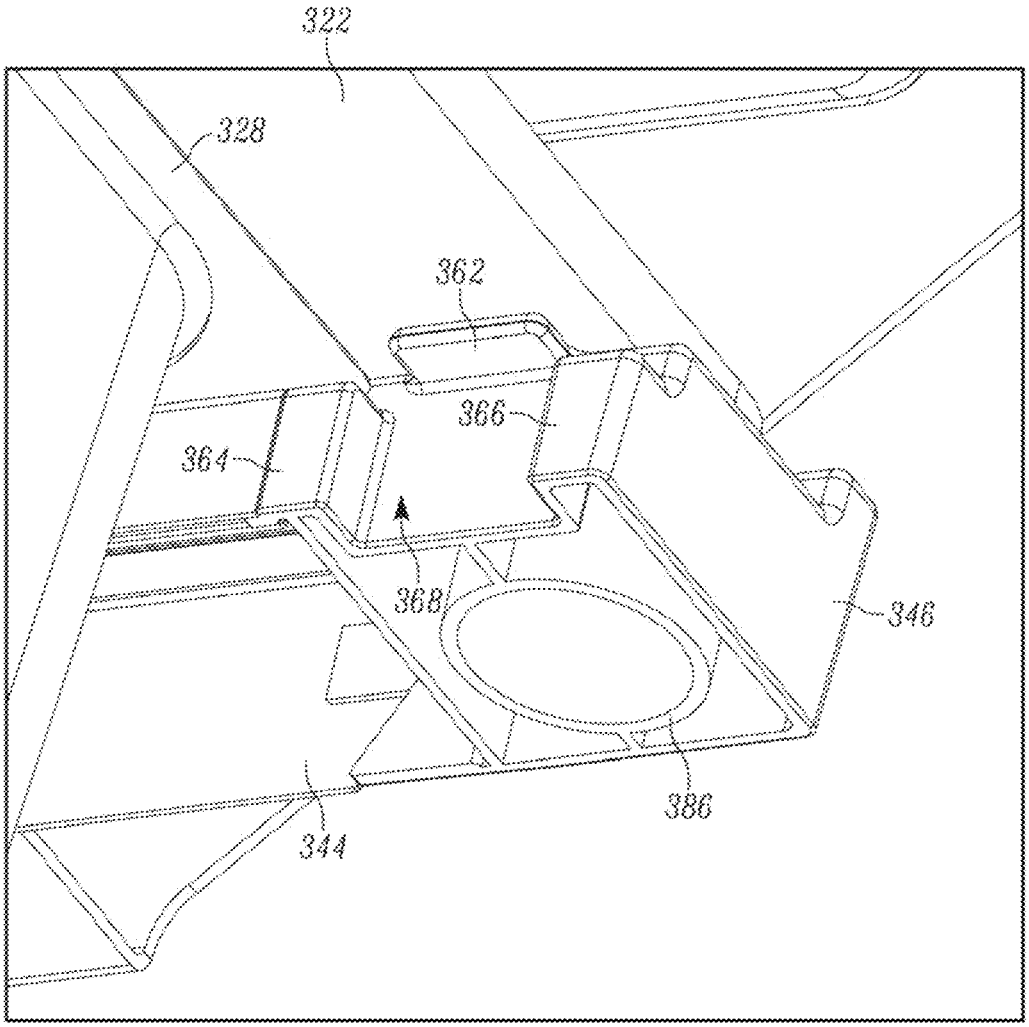
FIG. 25 is view of the endcap used in the example workstation of FIG. 21.
Figure 26:
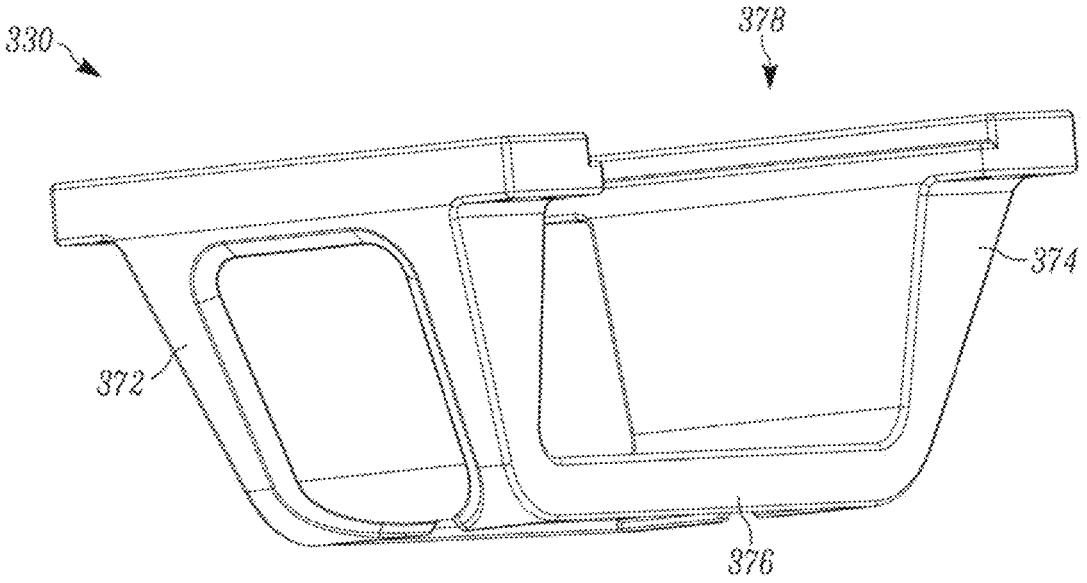
FIG. 26 is a view of a cradle used in the example workstation of FIG. 21.
Figure 27:
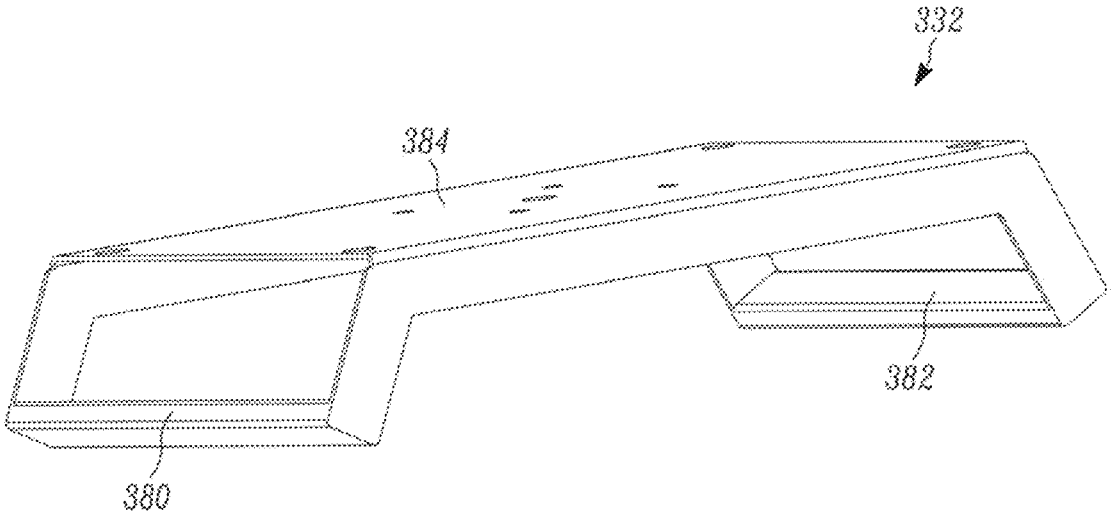
FIG. 27 is a view of a handle used in the example workstation of FIG. 21.
Figure 30:
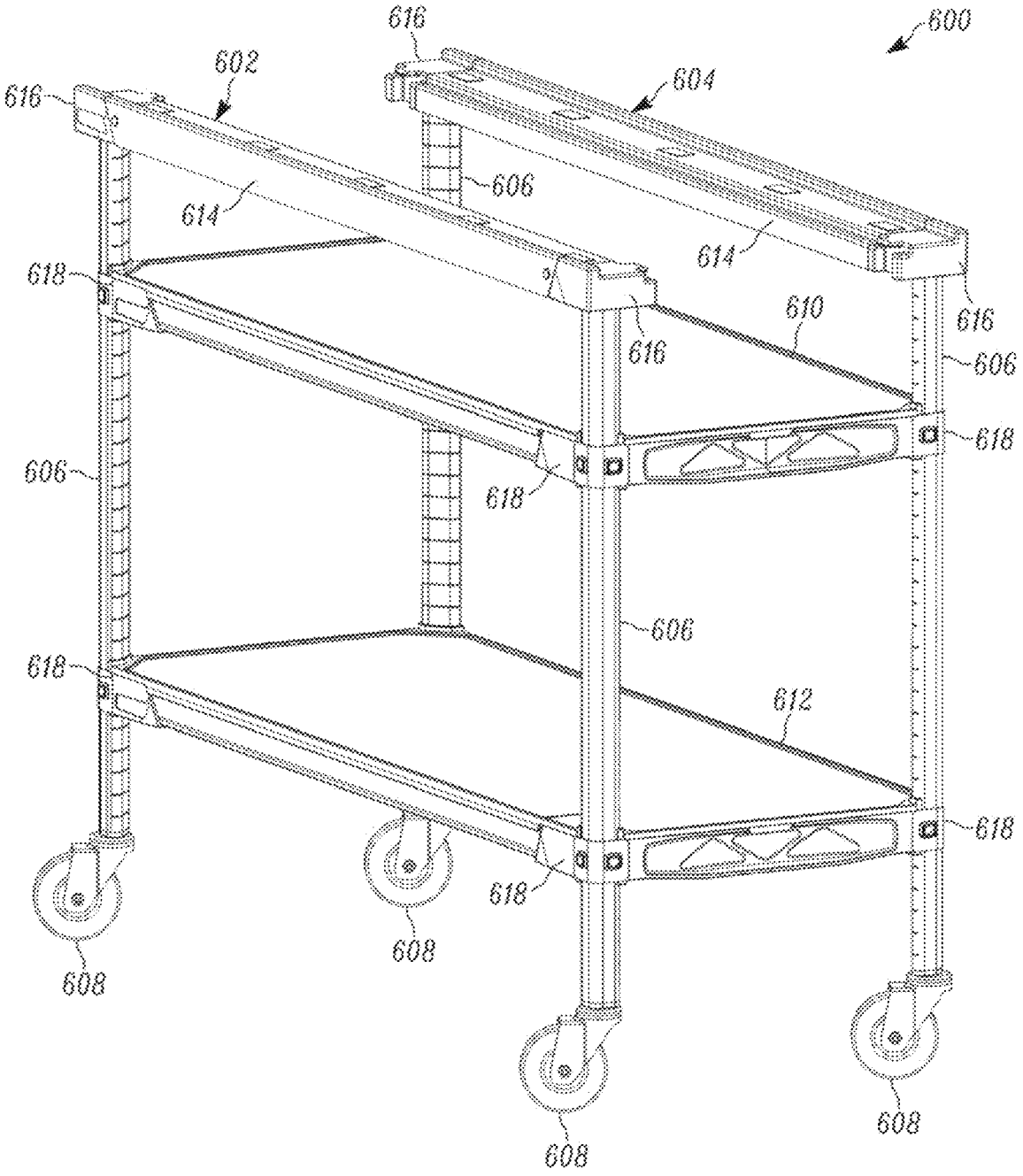
FIG. 30 is a perspective view of another example workstation in accordance with the present disclosure.

As shown in FIG. 25, the endcaps 346 can be hollow and can include one or more support ribs. The support ribs can be included in the endcaps 346 to provide rigidity to the endcaps 346. As shown, the endcaps 346 can also include a sleeve 386. In this example, the sleeve 386 is a cylindrical wall that extends vertically in the endcap 346. The sleeve 386 is sized to receive a cylinder or other feature. As will be described further below and as shown in FIG. 30, the sleeve 386 can be used to receive a leg 606. The leg 606 can be inserted into the endcap 346 and used to support a differently configured workstation 600. In other examples, the sleeve 386 can have different shapes to receive legs 606 with different cross-sectional shapes.

The endcaps 346 can also include other features. For example, the endcaps can include hooks, openings or other attachment features that can be used to hold or retain utensils, additional storage bins, cleaning materials, towels, aprons and the like. Such additional features can be molded into the endcaps 346 or connected to the endcaps 346.

As shown in FIGS. 21-23 and 26, the cradle 330 is a U-shaped member that connects the first and second rails 324, 326 to the base 306. The cradle 330 has a front side 372 and a back side 374 connected to one another by the bottom 376. The front side 372 is separated from the back side 374 to create a void 378. As shown in FIG. 23, the top regions of the front side 372 and back side 374 nest inside the first rail 324 and the second rail 326 to support the first rail 324 and the second rail 326. The top regions include a formation that corresponds to the multi-tiered profile of the first rail 324 and the second rail 326 as previously described. The cradle 330 can include one or more openings that extend through the cradle 330. One or more fasteners can be inserted through the one or more openings to secure the cradle 330 to the first rail 324 and/or the second rail 326.

The cradle 330 has a depth that is sized such that the pan 328 can slide between the front side 372 and the back side 374 on the second platform 340 without contacting or interfering with the bottom 376 of the cradle 330. The cradle 330, in this example, has a length that is less than the length of the longitudinal sections 344. The cradle 330 is positioned at a center of the work platform 302 such that the work platform 302 is balanced on the base 306.

In other examples, the cradle 330 can have different configurations, profiles and shapes. For example, the front side 372 and/or the back side 374 can include one or more separate arms that are spaced apart from one another rather than being a single piece as shown. In still other examples, the cradle 330 can have different cross-sectional profiles such as a V-shape or a rounded shape so long as the void 378 permits the pan 328 to move between the front side 372 and the back side 374. In other examples, the cradle 330 can also include hooks, pockets, bars or other storage features to permit utensils, ingredients, towels and other tools and material to be retained to the work station 300.

In the example shown, the cradle 330 is molded from a suitable plastic material. In other examples, the cradle 330 can be one or more separate pieces joined together or can be formed from a suitable metal, plastic or composite material.

As shown in FIGS. 21-23 and 27, the workstation 300 includes the handle 332. The handle 332 is connected to the cradle 330 using fasteners or can be connected using other suitable attachment methods such as welding, staking, adhesive or the like. The handle 332, in the example shown, includes a front bar 380, a rear bar 382 and a connecting portion 384. The connecting portion 384 connects to the cradle 330 and connects the front bar 380 to the rear bar 382. The handle 332 provides a rigid gripping location where a user can grip the workstation 300 to move the workstation 300 or to raise or lower the workstation 300. The handle 332 can also serve as a towel bar or utensil hook to store items on the workstation 300. In other examples, the handle 332 can include hooks, storage compartments, knife holders, ingredient bins and other features.

The handle 332 can be molded from a suitable plastic material. In other examples, the handle 332 can be one or more separate pieces joined together or can be constructed of or formed from a suitable metal, plastic or composite material.

Figure 21B:
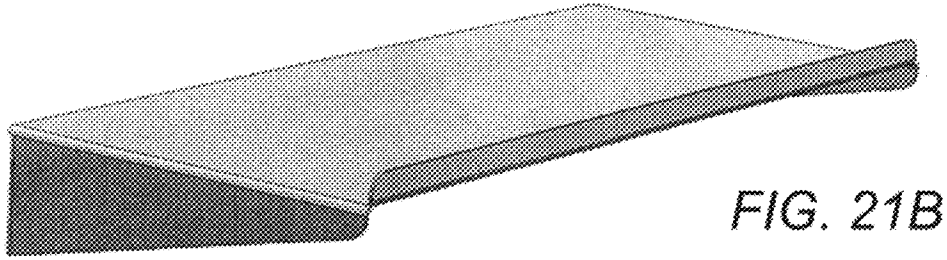
Figure 22:
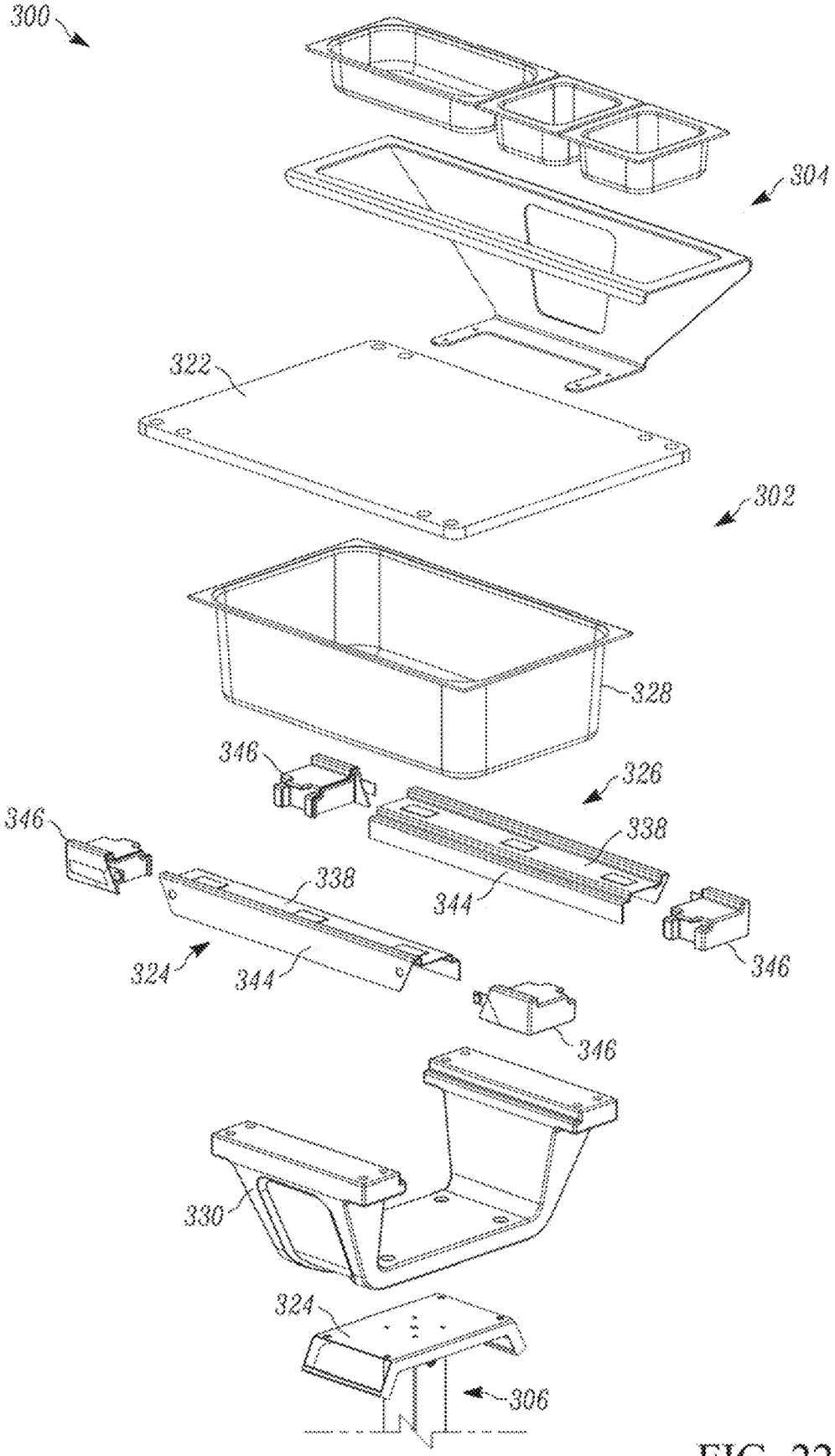
FIG. 22 is an exploded view of the example workstation of FIG. 21.

The hopper 304, as shown in FIGS. 21-23, is an element that is attached to the work platform 302 to hold one or more bins, pans or other storage receptacles or serve as an auxiliary work platform (see, e.g., FIG. 21B). The hopper 304, in the example shown, is connected to the cradle 330 and projects upward above the work surface 322. The hopper 304 can include one or more openings that are adapted to receive U.S. or gastronorm sized pans. The hopper 304 can also include hooks, spice racks, knife holders and cleaning materials. In the example shown, the hopper 304 is formed from a suitable metal, such as stainless steel, but in other examples it can be molded or otherwise manufactured from suitable other metals, plastics or composites.

The workstation 300, as previously described, is a modular mobile structure that can be used in many different industries and applications including the food service industry, the medical industry, the manufacturing industry, in laboratory settings, in educational settings, in demonstration settings and the like. With regards to many of these industries, and in particular the food service industry, the ability to clean the workstation 300 is an important attribute. As discussed, the workstation 300 can be easily assembled and disassembled to clean the various components after use.

In addition to the features previously described, the different elements of the workstation 300 can include drain holes or venting features that permit water to be sprayed on the workstation 300 during cleaning and then permitted to dry. For example, the support column 308 can include one or more drain holes that can include removable plugs that permit the interior of the support column 308 to be sprayed with water and other cleaning materials. The drain holes permit the water and/or cleaning fluids to drain from the support column. The other elements of the workstation 300, or the other workstations previously described, can also include drain holes to permit the cleaning of the workstations and their components.

In addition, the components of the workstations 100, 180, 184, 200 or others described herein, can be manufactured from materials that include anti-microbial or anti-bacterial properties. The components can also include coatings or other treatments that inhibit the growth of microbes and/or bacteria.

Figure 28:
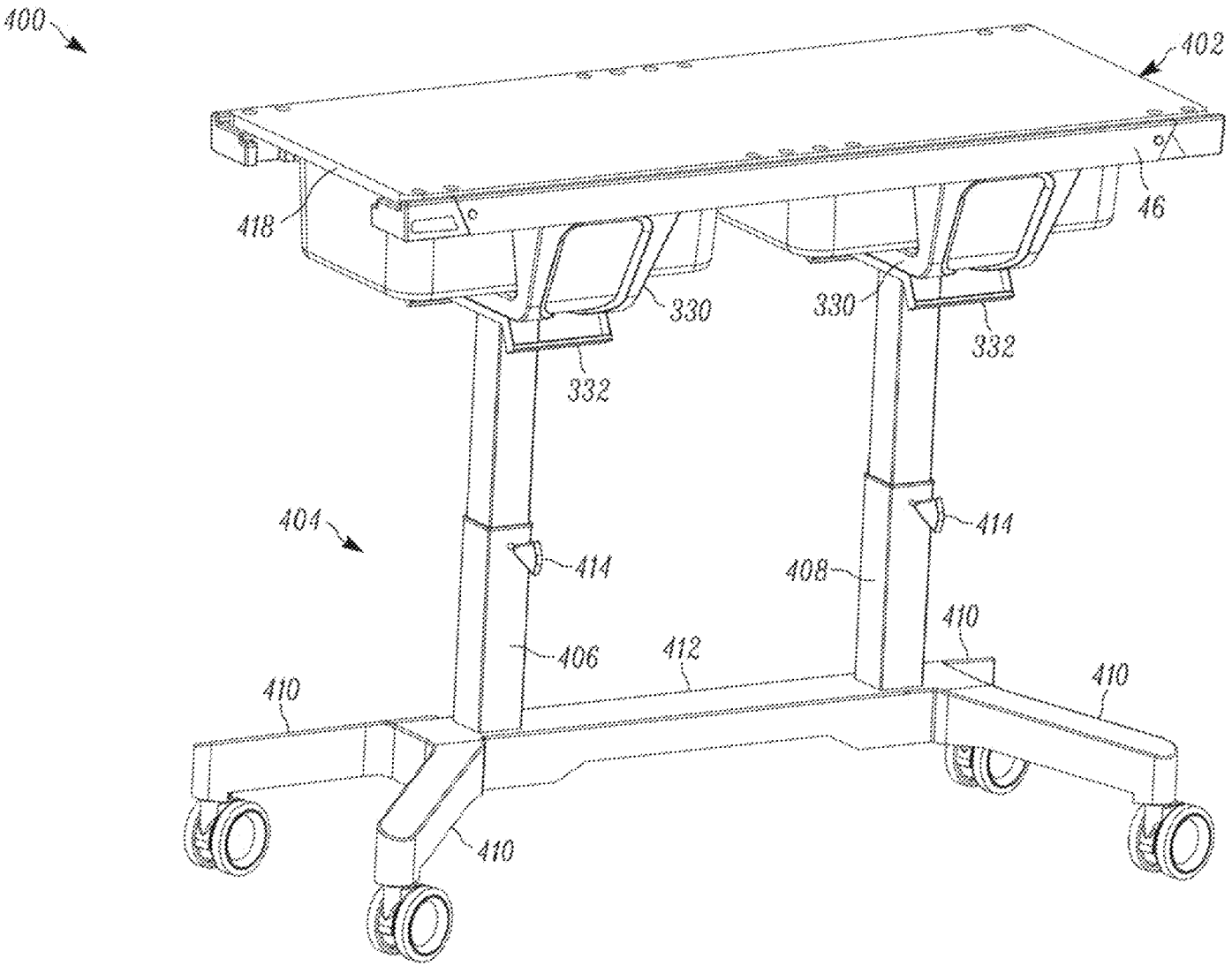
FIG. 28 is a perspective view of another example workstation in accordance with the present disclosure.
Figure 28A:
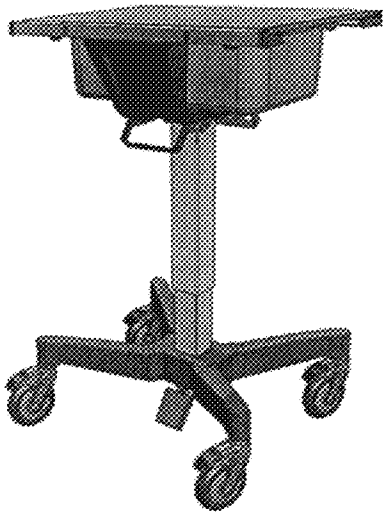
FIGS. 28A-28G show perspective views of additional examples of workstations in accordance with the present disclosure.
Figure 28B:
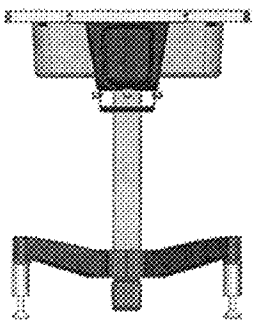
Figure 28C:
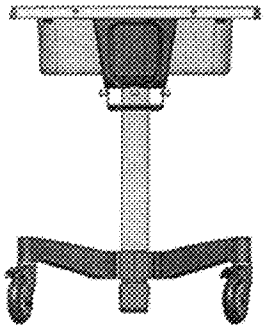
Figure 28D:
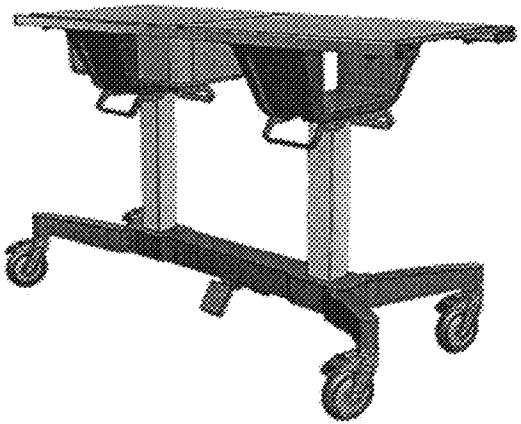
Figure 28E:
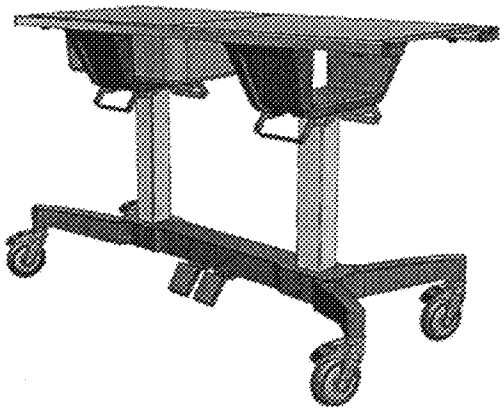
Figure 28G:
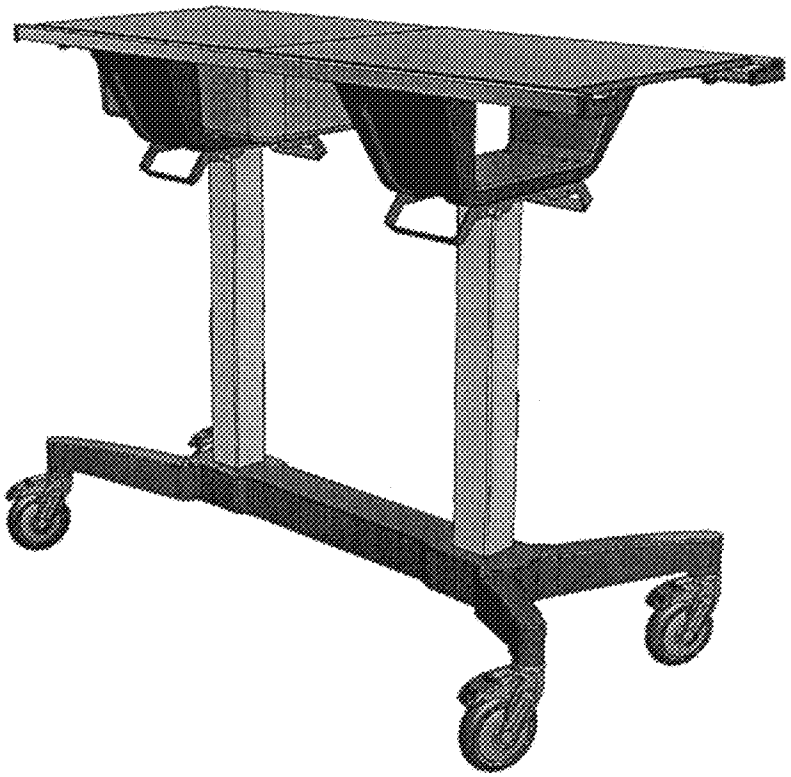
Figure 28F:
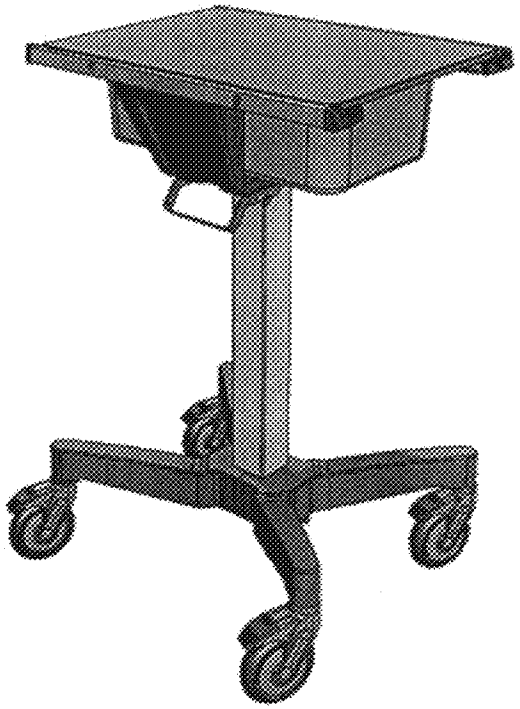

Referring now to FIG. 28, still another example workstation is shown. In this example, the workstation 400 includes a work platform 402 and a base 404. In this example, the workstation 400 is similar to the workstation 300 except that the workstation 400 is longer than the workstation 300. As can be seen, the components previously described can be adapted and used in a manner to create workstations of various lengths. In addition, customized lengths can be created using one or more the previously described components of workstation 300.

In the example shown, the base 404 is similar to that previously described with respect to workstation 300 except that the base 404 includes a first support column 406 and a second support column 408. The spokes 410 are connected to one another by a center portion 412. The center portion 412 is of a sufficient length that the first support column 406 and the second support column 408 can be connected to the center portion 412.

The first support column 406 and the second support column 408, in this example, are telescoping support members with a square or rectangular cross-section. The first support column 406 and/or the second support column can include pins 414 as shown. The pins 414 can be inserted through the first support column 406 and or the second support column 408 to fix the support columns at a desired height. As such, a series of holes extend through the first support column 406 and/or the second support column 408 to permit the work platform 402 to be positioned at multiple different heights.

The spokes 410 and center portion 412 of the base 404 can be molded into the shape as shown or can be manufactured from separate pieces and joined together. Still further, in other examples, the spokes 410 are removable from the center portion 412 and the center portion 412 can be made of differing lengths such that different workstations 400 can be assembled that have different overall lengths. In such instances, the center portions 412 can permit the bases 404 to have more than two support columns 406, 408 or to accept support columns of differing shapes or cross-sectional profiles.

The work platform 402 is similar to the work platform 302 previously described except that the work platform 402 includes two cradles 330 and two handles 332. As can be appreciated, the first rail 416 and the second rail 418 are longer than the first rail 324 and the second rail 326 of the workstation 300. As shown, the first rail 416 and the second rail 418, in this example, are single lengths of material with endcaps 420 positioned at the ends. In other examples, the first rail 416 and/or the second rail 418 can be multiple lengths that are connected together using splicing members (not shown).

Figure 29:
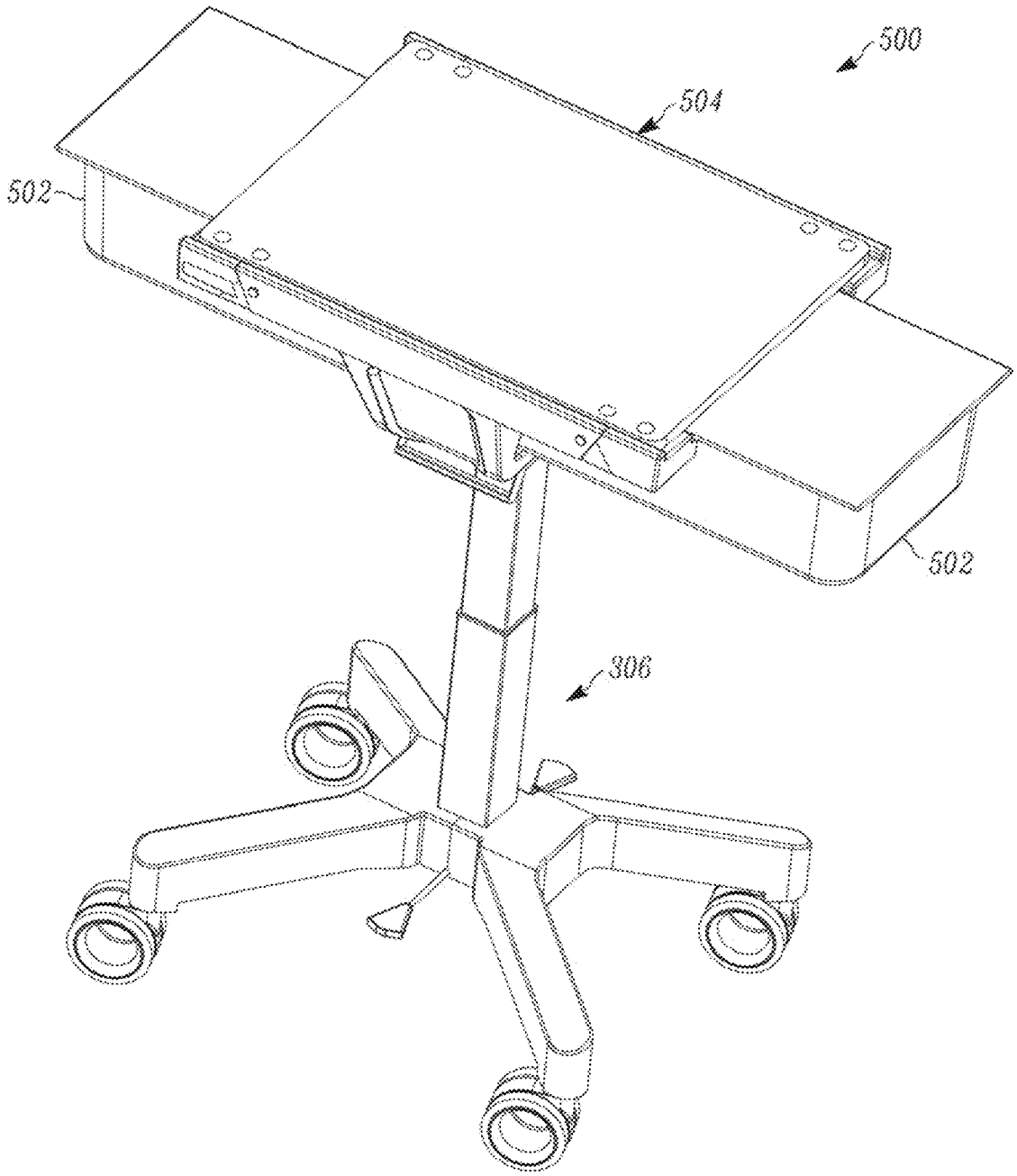
FIG. 29 is a perspective view of another example workstation in accordance with the present disclosure.
Figure 29A:
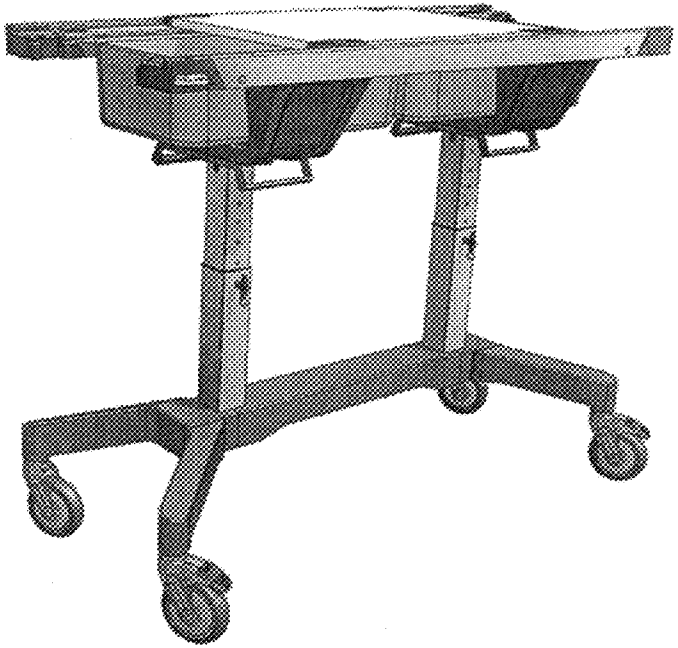
FIG. 29A is a perspective view of another example workstation in accordance with the present disclosure.
Figure 29B:
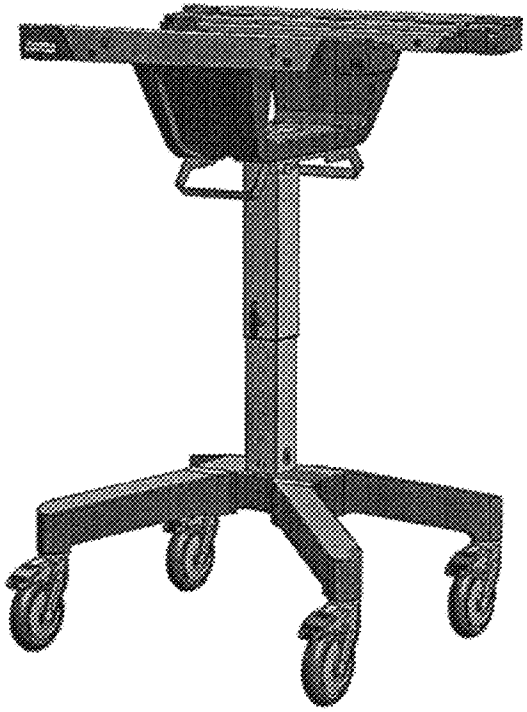
FIG. 29B is a perspective view showing another example workstation in accordance with the present disclosure having a work platform and a pan removed for clarity.
Figure 29C:
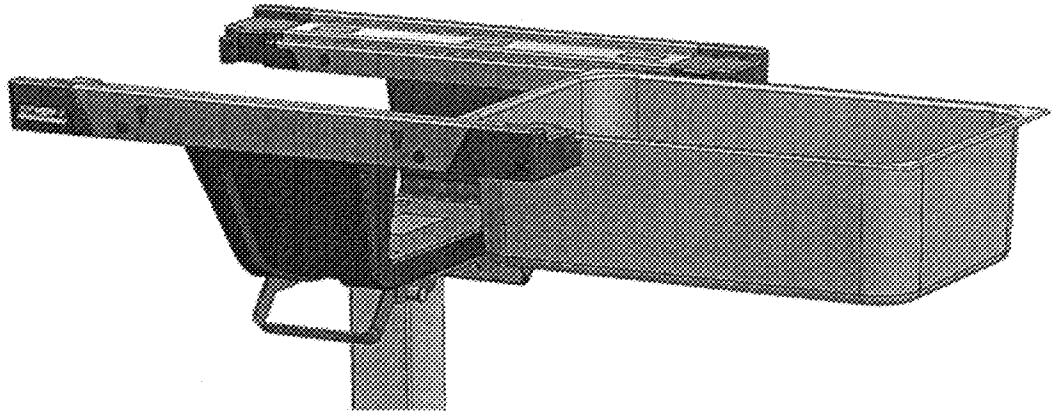
FIG. 29C is a partial perspective view showing the workstation of FIG. 29B and having a work platform removed for clarity.
Figure 29E:
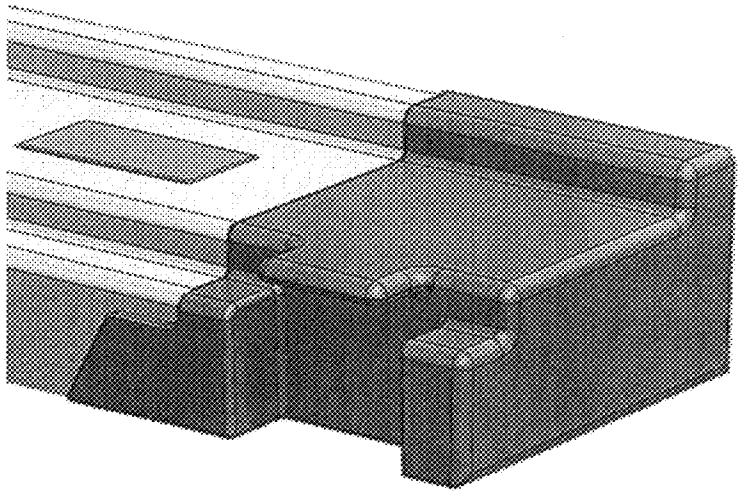
FIG. 29E is a perspective view showing an enlarged end detail of the rail of FIG. 29D.
Figure 29D:
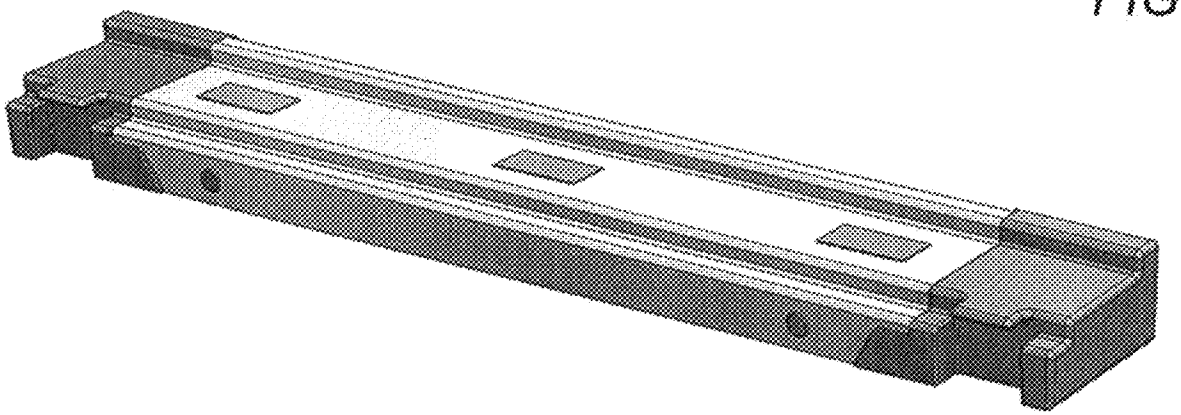
FIG. 29D is a perspective view showing a rail of the workstation of FIG. 29C.
Figure 29F:
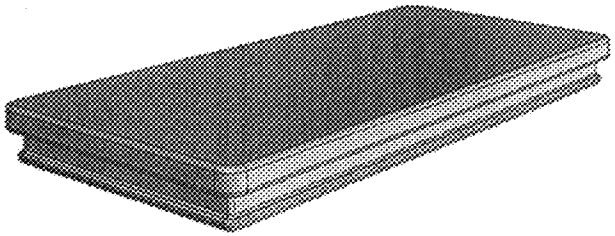
FIG. 29F is a perspective view showing a pad for the rail of FIG. 29D.

Referring now to FIG. 29, yet another example workstation 500 is shown. This example workstation 500 is similar to the workstation 300. In this example, the workstation 500 includes two pans 502 that are positioned in the work platform 504. As can be seen, the workstation 300 can be fit with one or more different U.S. or gastronorm sized pans.

FIG. 30 shows another example workstation of the present disclosure. This example workstation 600 uses one or more of the components of the workstation 300. As can be seen, the modular and configurable nature of the workstation 300 and its related components is shown in the example workstation 600. The workstation 600, in this example, includes a first rail 602, a second rail 604, legs 606, casters 608, a first shelf 610 and a second shelf 612.

The first rail 602 and the second rail 604 are similar to the first rail 324 and the second rail 326 previously described. The first rail 602 and the second rail 604 have the same cross-sectional profiles as that previously described and establish a first platform that can support a work surface (not shown) and a second platform that can support a pan (not shown).

The first rail 602 and the second rail 604 each include a longitudinal section 614 and two endcaps 616. The longitudinal sections 614 are connected between the pair of endcaps 616. The endcaps 616 include the previously described sleeves 386 (FIG. 25) that are cylindrical formations that are adapted to receive the legs 606 therein. In this manner, the first rail 602 and the second rail 604 are supported at a desired height.

The casters 608 are connected at the bottom of the legs 606. Thus, a mobile workstation 600 is formed using the modular rail and endcap system previously described with respect to workstation 300. The example workstation 600 also includes the first shelf 610 and the second shelf 612. The first shelf 610 and the second shelf 612 are rectangular members and include leg attachments 618 at each corner that grip the legs 606. In this manner, the first shelf 610 and the second shelf 612 can connect to the legs 606 at a desired position. As can be appreciated, it is desirable to position the first shelf 610 at a vertical distance away from the first rail 602 and the second rail 604 so that a pan that is inserted into the second platform of the first rail 602 and the second rail 604 can slide along and be removed from the second platform without interference.

The first shelf 610 and the second shelf 612 can be positioned at any desired height along the legs 606. In other examples, the workstation 600 can include only one shelf or more than two shelves. In still other examples, the workstation 600 can include other storage or features connected to the legs 606 or to the first rail 602 and/or the second rail 604.

Figure 30A:
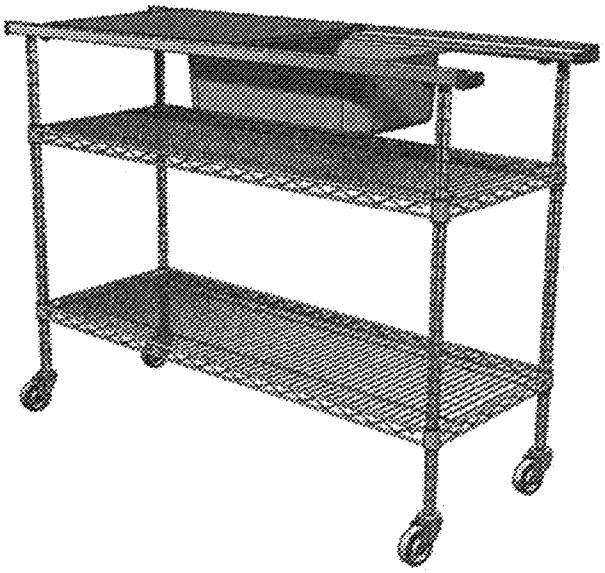
FIG. 30A-30C are perspective views of still other examples of workstations in accordance with the present disclosure.
Figure 30C:
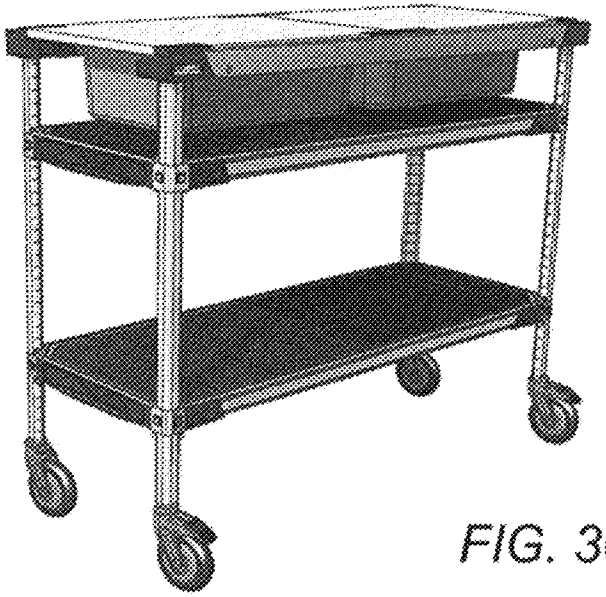
Figure 30B:
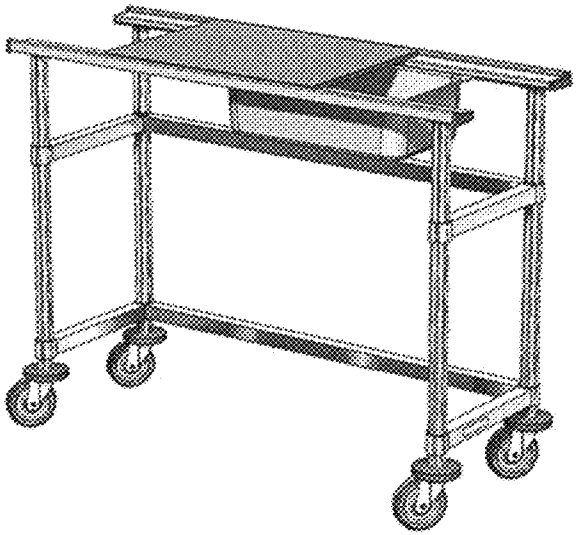
Figure 31:
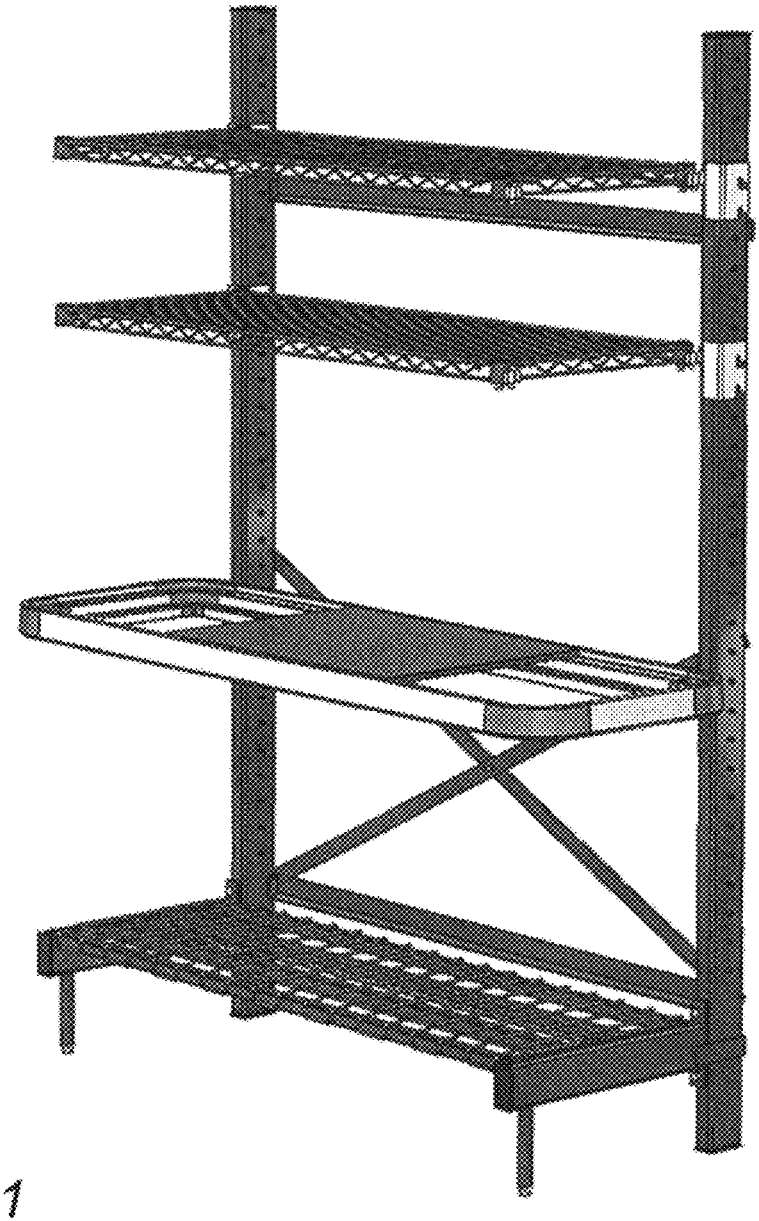
FIG. 31 is a perspective view of another example workstation in accordance with the present disclosure included a part of a stand-alone cantilevered rack or shelf system.

FIGS. 30A to 30C show perspective views of additional examples of workstations in accordance with the present disclosure which share many features of the workstation 600. For example, the workstation of FIG. 30A includes, in this example, first and second rails, legs 606, casters 608, and first and second shelves.

Moreover, the workstation can include a height adjustment feature disposed between the legs and the rails, as shown in FIG. 32. The height adjustment feature enables the workstation, and particularly the height of the work platform, to be further configured and customized. In this regard, the height adjustment feature includes an extension portion and a locking collar. The extension portion engages the rails at an upper end and the legs at a lower end. The extension portion may or may not be integrally formed with the rails and/or the rail endcaps. A tapered aperture at the lower end of the extension portion engages a mating support or collar that can be attached to the leg at various positions on the leg, representing different heights for the work platform. Height adjustability of the work platform can be accomplished similarly to the manner of adjusting the height of shelving that is described in U.S. Pat. No. 3,424,111, the disclosure of which is hereby incorporated by reference.

The foregoing description includes many different embodiments of example workstations and related features. Any of the variations, features or elements of the example workstations can be used in connection with the other workstations as applicable.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A food preparation workstation comprising:

a first rail defining first boundary of the workstation and including a first support surface and a second support surface, the first support surface positioned horizontally along a length of the first rail, the second support surface positioned parallel to and vertically spaced apart from the first support surface;

a second rail spaced a distance from the first rail and defining a second boundary of the workstation and including a third support surface and a fourth support surface, the third support surface positioned horizontally along a length of the second rail, the fourth support surface positioned parallel to and vertically spaced apart from the third support surface; and at least one vertically-oriented support member supporting the first rail and the second rail opposite to one another such that the first support surface and the third support surface are aligned in a first plane and define a first platform and the second support surface and the fourth support surface are aligned in a second plane to define a second platform, wherein the first platform is configured to removably receive a work surface and the second platform is configured to removably receive a storage receptacle, wherein the work surface is operable to translate from a first position on the first platform to a second position on the first platform, and wherein at least one of the first rail and the second rail defines at least one aperture to removably attach an accessory.

2. The food preparation workstation of claim 1, wherein the work surface is operable to slide on the first platform in the first plane vertically above the storage receptacle and without interfering with the storage receptacle.

3. The food preparation workstation of claim 1, wherein the second support surface and the fourth support surface are positioned intermediate the first support surface and the third support surface such that the second platform is positioned inward of the first platform relative to at least one of the first and second boundaries and vertically below the first platform.

4. The food preparation workstation of claim 1, wherein the storage receptacle comprises a food service pan;

wherein the food service pan is disposed between the first rail and the second rail; and wherein the work surface comprises a cutting board.

5. The food preparation workstation of claim 1, wherein the first rail includes a first ridge that projects vertically upward from the first support surface along the length of the first rail and the second rail includes a second ridge that projects vertically upward from the third support surface along the length of the second rail, the first ridge and the second ridge operable to guide the work surface during translation of the work surface from the first position to the second position on the first platform.

6. The food preparation workstation of claim 1, wherein the first rail comprises a longitudinal section removably positioned between a first pair of endcaps;

wherein the second rail comprises a second longitudinal section removably positioned between a second pair of endcaps;

wherein each endcap in the first pair of endcaps and the second pair of endcaps includes a sleeve;

wherein the at least one vertically-oriented support member includes four vertical support members; and wherein each of the four vertically-oriented support members is removably received in the sleeve of a respective one of the endcaps.

7. The food preparation workstation of claim 6, further comprising a plurality of collars, each of the plurality of collars positioned between a respective sleeve and a respective vertically-oriented support member to maintain a relative position of the respective vertically-oriented support member to the respective sleeve, wherein a first and second of the four vertically-oriented support members support the first rail at a first vertical height and a third and fourth of the four vertically-oriented support members support the second rail at the first vertical height;

wherein each sleeve has an elongated tubular shape; and wherein each collar is operable to engage the respective vertically-oriented support member in at least a first vertical location and in a second vertical location on the respective vertically-oriented support member, the first vertical location corresponding to the first vertical height of the first and second rails and the second vertical location corresponding to a second vertical height of the first and second rails.

8. The food preparation workstation of claim 7, wherein each sleeve has an elongated tubular shape; and wherein each collar is operable to engage the respective vertically-oriented support member in at least a first vertical location and in a second vertical location on the respective vertically-oriented support member, the first vertical location corresponding to the first vertical height of the first and second rails and the second vertical location corresponding to a second vertical height of the first and second rails.

9. The food preparation workstation of claim 1, wherein:

the at least one vertically-oriented support member includes a first vertically-oriented support member, a second vertically-oriented support member, a third vertically-oriented support member, and a fourth vertically-oriented support member, the first vertically-oriented support member is positioned at or near a first longitudinal end of the first rail, the second vertically-oriented support member is positioned at or near a second longitudinal end of the first rail, the third vertically-oriented support member is positioned at or near a first longitudinal end of the third rail, and the fourth vertically-oriented support member is positioned at or near a second longitudinal end of the second rail.

10. The food preparation workstation of claim 1, wherein the first rail is spaced apart from the second rail at a predetermined distance that is configured to accommodate the work surface on the first and third support surfaces in the first plane and the storage receptacle on the second and fourth support surfaces in the second plane.

11. The food preparation workstation of claim 1, wherein the first plane and the second plane are horizontal planes; and wherein the first plane is positioned vertically above the second plane.

12. The food preparation workstation of claim 1, wherein the at least one aperture is a plurality of attachment holes and the accessory is one of a hook, towel bar, storage compartment, knife holder, ingredient bin and auxiliary work platform.

13. The food preparation workstation of claim 1, wherein the work surface is operable to slide along the first plane vertically above the storage receptacle and without interfering with the storage receptacle.

14. The food preparation workstation of claim 1, further comprising:

a cradle including a first side, a second side and a bottom, the first side connected to and spaced apart from the second side by the bottom;

wherein the first rail is connected to the first side of the cradle, the first rail defining a front side of the workstation;

the second rail is connected to the second side of the cradle, the second rail defining a rear side of the workstation;

wherein the cradle is generally U-shaped and the bottom of the cradle is vertically spaced below the second platform to allow the storage receptacle to be positioned between the first and second sides of the cradle and vertically above the bottom of the cradle; and wherein the at least one vertically-oriented support member is connected to the cradle and supports the cradle at a first vertical height.

15. The food preparation workstation of claim 14, wherein the at least one vertically-oriented support member includes two or more telescoping sections that can move relative to one another to move the cradle from the first vertical height to a second vertical height.

16. The food preparation workstation of claim 1, wherein the storage receptacle is locatable in a first position and a second position relative to the work surface on the second platform.

17. The food preparation workstation of claim 1, wherein the first rail includes at least one pad on the first support surface or the second support surface, the at least one pad comprising a material with a higher coefficient of friction than a material of the first rail that is adjacent the at least one pad.

18. The food preparation workstation of claim 1, wherein the first rail includes a plurality of dimples or projections positioned on the first support surface, the plurality of dimples or projections configured to nest with a corresponding plurality of projections or dimples on the work surface to resist movement of the work surface relative to the first rail.

19. The food preparation workstation of claim 1, wherein the first rail comprises a longitudinal section removably positioned between a pair of endcaps; and wherein each endcap includes a top projection projecting inward in a direction substantially perpendicular to a longitudinal direction of the first or second rails, the top projection spaced vertically above the second support surface to prevent the storage receptacle from disengaging the second support surface.

20. A mobile, multi-tiered food preparation workstation comprising:

a plurality of vertically-extending support posts, wherein each vertically-extending support post comprises a lower end and an upper end;

first and second horizontally-extending frame rails, wherein the first frame rail comprises a first rail end and a second rail end and extends a first rail length between the first rail end and the second rail end and wherein the second frame rail comprises a third rail end and a fourth rail end and extends a second rail length between the third rail end and the fourth rail end;

wherein the first frame rail is supported at first rail end by a first upper end of a first vertically-extending support post of the plurality of vertical support posts and at the second rail end by a second upper end of a second vertically-extending support post of the plurality of vertical support posts;

wherein the second frame rail is supported at the third rail end by a third upper end of a third vertically-extending support post of the plurality of vertical support posts and at the fourth rail end by a fourth upper end of a fourth vertically-extending support post of the plurality of vertical support posts;

a plurality of casters, wherein a respective caster is attached to a respective lower end of each of the first, second, third and fourth vertically-extending support posts of the plurality of vertically-extending support posts;

wherein the first frame rail extends along a first horizontal axis and defines a forward boundary of the workstation and the second frame rail extends along a second horizontal axis and defines a rearward boundary of the workstation, wherein the forward boundary and the rearward boundary are spaced apart by a distance to define a workspace intermediate of the first and second frame rails;

wherein the first frame rail defines a first support surface and a second support surface, wherein the first support surface is located at a first vertical distance from the upper end of the first vertically-extending support post and extends the first rail length, wherein the second support surface is located at a second vertical distance from the upper end of the first vertically-extending support post, wherein the second vertical distance is less than the first vertical distance, and wherein the second support surface lies inward from the first support surface;

wherein the second frame rail defines a third support surface and a fourth support surface, wherein the third support surface is located at a third vertical distance from the upper end of the first vertically-extending support post and extends the second rail length, wherein the fourth support surface is located at a fourth vertical distance from the upper end of the first vertically-extending support post, wherein the fourth vertical distance is less than the third vertical distance, and wherein the fourth support surface lies inward from the third support surface;

wherein the first and third support surfaces of the first and second frame rails lie in a first common plane and the second and fourth support surfaces of the first and second frame rails lie in a second common plane; and at least one frame member supported by at least two of the first, second, third and fourth vertically-extending support posts at a fifth vertical distance from the upper end of the first vertically-extending support post.

21. The mobile, multi-tiered food preparation workstation of claim 20, wherein the fifth vertical distance is greater than each of the second and fourth vertical distances; and wherein the at least one frame member comprises a generally rectangular, horizontally-oriented shelf, wherein at least two corners of the shelf are supported by the at least two of the first, second, third and fourth vertically-extending support posts.

22. The mobile, multi-tiered food preparation workstation of claim 20, wherein the fifth vertical distance is greater than each of the second and fourth vertical distances; and wherein the at least one frame member comprises at least one cross-brace extending between the at least two of the first, second, third and fourth vertically-extending support posts, and wherein opposite ends of the cross-brace are respectively attached to the at least two of the first, second, third and fourth vertically-extending support posts.

23. The mobile, multi-tiered food preparation workstation of claim 20, further comprising one of a work platform disposed within the workspace and supported by the first and third support surfaces and a gastronorm pan disposed within the workspace and supported by the second and fourth support surfaces.

24. The mobile, multi-tiered food preparation workstation of claim 20, further comprising a cutting board disposed within the workspace and supported by the first and third support surfaces and a gastronorm pan disposed within the workspace and supported by the second and fourth support surfaces.

25. The mobile, multi-tiered food preparation workstation of claim 20, further comprising a work platform disposed within the workspace and supported by the first and third support surfaces.

26. The mobile, multi-tiered food preparation workstation of claim 25, wherein at least one of the first support surface and third support surface comprises a first portion having a first coefficient of friction and a second portion having a second coefficient of friction, wherein the first coefficient of friction is greater than the second coefficient of friction.

27. The mobile, multi-tiered food preparation workstation of claim 20, further comprising a height adjustment device disposed between at least one of the plurality of vertically-extending support posts and at least one of the frame rails, wherein the height adjustment device is operable to alter at least one of the first vertical distance and the third vertical distance.

28. The mobile, multi-tiered food preparation workstation of claim 27, wherein the height adjustment devices comprises at least one locking collar disposed between at least one of the first, second, third and fourth rail ends and at least one of the first, second, third and fourth vertically-extending support posts.

* * * * *